US010827851B2

(12) United States Patent
Karp et al.

(10) Patent No.: US 10,827,851 B2
(45) Date of Patent: Nov. 10, 2020

(54) INFANT CALMING/SLEEP-AID DEVICE AND METHOD OF USE

(71) Applicant: Happiest Baby, Inc., Los Angeles, CA (US)

(72) Inventors: Harvey Neil Karp, Los Angeles, CA (US); Matthew R. Berlin, Somerville, MA (US); Jesse V. Gray, Somerville, MA (US); Bill Walter Washabaugh, Brooklyn, NY (US); Deb Kumar Roy, Belmont, MA (US)

(73) Assignee: HB Innovations, Inc., Los Angeles, CA (US)

( * ) Notice: Subject to any disclaimer, the term of this patent is extended or adjusted under 35 U.S.C. 154(b) by 924 days.

(21) Appl. No.: 15/051,308

(22) Filed: Feb. 23, 2016

(65) Prior Publication Data

US 2016/0166081 A1 Jun. 16, 2016

Related U.S. Application Data

(63) Continuation of application No. 14/353,258, filed as application No. PCT/US2012/061069 on Oct. 19, 2012, now abandoned.

(Continued)

(51) Int. Cl.
*A47D 9/02* (2006.01)
*A47D 15/00* (2006.01)

(52) U.S. Cl.
CPC ..... *A47D 9/02* (2013.01); *A47D 15/00* (2013.01)

(58) Field of Classification Search
CPC ..... A47D 9/00; A47D 9/02; A47D 13/102; A47D 13/105; Y10S 5/904; A47C 3/029

(Continued)

(56) References Cited

U.S. PATENT DOCUMENTS 1,332,400 A 3/1920 Johnson
1,897,258 A 2/1933 Jenne (Continued)

FOREIGN PATENT DOCUMENTS

CA 2459037 A1 8/2005
CA 2760609 A1 11/2010

(Continued)

OTHER PUBLICATIONS

Oval Crib, Fine Woodworking, http://www.finewoodworking.com/readerproject/2009/11/11/oval-crib (sited visited Apr. 4, 2018), Nov. 11, 2009.

(Continued)

*Primary Examiner* — Myles A Throop

(74) *Attorney, Agent, or Firm* — Akerman LLP

(57) ABSTRACT

An infant calming/sleep-aid device includes a main moving platform that moves in a reciprocating manner and an actuator that drives the reciprocating movement of the main moving platform. The moving head platform is linked to the main moving platform and at least one of a motion sensing device and a sound sensing device are either at or proximate to a moving head platform that is pivotally linked to the main moving platform. A logic circuit links at least one of the motion and sound sensing devices of the infant calming/sleep aid-device to the main moving platform whereby signals detected modulate movement of the main moving platform. A sound generating device is linked to the logic circuit.

20 Claims, 14 Drawing Sheets

Related U.S. Application Data

(60) Provisional application No. 61/549,627, filed on Oct. 20, 2011.

(58) Field of Classification Search
USPC ..... 5/81.1 RP
See application file for complete search history.

(56) References Cited

U.S. PATENT DOCUMENTS

D90,696 S 9/1933 Caldwell
D128,488 S 7/1941 Buckner
D158,030 S 4/1950 Wagner
2,508,110 A 5/1950 Hansen
2,523,422 A 9/1950 Dunn
2,808,828 A 10/1957 Rubin
2,873,458 A 2/1959 Adamson
2,974,325 A 3/1961 Mango
2,992,440 A 7/1961 Revolt
3,146,736 A 9/1964 Robert
3,536,067 A 10/1970 Sternagel
D224,822 S 9/1972 Lee, Jr.
3,789,439 A 2/1974 Berg
D232,279 S 8/1974 White
3,886,607 A * 6/1975 Dunn ..... A47D 9/005 5/104
D244,890 S 7/1977 Adams
4,553,485 A 11/1985 Lee
4,611,353 A 9/1986 Als et al.
4,619,270 A 10/1986 Margolis
4,750,223 A 6/1988 D'Arcy
4,934,997 A 6/1990 Skakas
D316,339 S 4/1991 Taylor
5,037,375 A * 8/1991 Gatts ..... A61G 7/065 128/898
D320,316 S 10/1991 Arnold
5,129,406 A 7/1992 Magnusen et al.
5,183,457 A 2/1993 Gatts et al.
5,228,155 A 7/1993 Shultz
5,295,490 A 3/1994 Dodakian
5,311,622 A * 5/1994 Allen ..... A61G 7/1076 108/142
5,381,569 A * 1/1995 Church ..... A61G 7/1076 108/139
5,384,922 A * 1/1995 Jobe ..... A61G 5/12 5/507.1
5,385,153 A 1/1995 Jamieson et al.
5,398,353 A 3/1995 Sachathamakul
D367,979 S 3/1996 Lewis
5,577,450 A 11/1996 Huang
5,668,780 A 9/1997 Hsieh
5,684,460 A 11/1997 Scanlon
5,706,533 A 1/1998 Opheim
5,711,045 A 1/1998 Caster et al.
5,806,113 A 9/1998 McMahan et al.
D401,454 S 11/1998 De Blaay
5,845,350 A 12/1998 Beemiller et al.
5,852,827 A 12/1998 Lear et al.
5,855,031 A 1/1999 Swift
5,881,408 A 3/1999 Bashista et al.
5,931,534 A * 8/1999 Hutter ..... A47C 3/18 297/217.3
D413,454 S 9/1999 Kasem
D417,090 S 11/1999 Reynolds
D418,440 S 1/2000 Dallaire
6,009,576 A 1/2000 Grammet et al.
6,011,477 A 1/2000 Teodorescu et al.
6,068,566 A * 5/2000 Kim ..... A47D 9/02 474/84
6,146,332 A 11/2000 Pinsonneault
6,148,455 A 11/2000 Kassem
6,155,976 A * 12/2000 Sackner ..... A47C 21/006 5/600
6,343,994 B1 * 2/2002 Clarke ..... A47D 13/105 297/273
6,386,986 B1 5/2002 Sonner
6,393,612 B1 5/2002 Thach et al.
6,415,442 B1 7/2002 Smith et al.
6,498,652 B1 12/2002 Varshneya et al.
6,588,033 B1 7/2003 Welsh
6,594,834 B2 7/2003 Fenty
6,652,469 B2 11/2003 Pinsonnault
6,662,390 B1 12/2003 Berger et al.
6,839,924 B2 1/2005 Sims et al.
6,868,566 B2 3/2005 Gatten et al.
6,907,626 B1 6/2005 Welsh
6,916,249 B2 * 7/2005 Meade ..... A47D 13/105 472/119
6,928,674 B2 8/2005 Blackburn
6,966,082 B2 11/2005 Bloemer et al.
D512,466 S 12/2005 White
6,978,479 B2 12/2005 Thach et al.
D518,942 S 4/2006 Dandrea
7,043,783 B2 5/2006 Gatten et al.
7,076,819 B2 7/2006 Trani et al.
D526,133 S 8/2006 Song
7,100,724 B2 9/2006 Haigh et al.
7,123,758 B2 10/2006 Mostafavi et al.
D536,191 S 2/2007 Kasem
D536,550 S 2/2007 Kasem
7,181,789 B2 2/2007 Gatten et al.
7,203,981 B1 4/2007 Cowgill et al.
7,246,392 B2 7/2007 Schmid et al.
D561,978 S 2/2008 Sioleau
7,337,482 B2 3/2008 Byrne et al.
7,347,806 B2 3/2008 Nakano et al.
7,406,725 B2 8/2008 Martin et al.
7,427,921 B2 9/2008 Van
7,485,086 B2 2/2009 Dickie et al.
7,587,769 B1 9/2009 McDermott et al.
7,587,772 B2 9/2009 Ward et al.
D605,870 S 12/2009 Bergkvist
D606,282 S 12/2009 Chen
7,685,657 B1 3/2010 Hernandez et al.
D613,091 S 4/2010 Taylor
7,722,118 B2 5/2010 Bapst et al.
D616,665 S 6/2010 Dumais
7,743,442 B2 6/2010 Maloney et al.
7,774,875 B1 8/2010 Zeidman et al.
7,785,257 B2 8/2010 Mack et al.
7,857,677 B2 12/2010 Kamm
7,918,505 B2 4/2011 King et al.
7,954,187 B1 6/2011 Earnest et al.
D644,413 S 9/2011 Keall
8,011,037 B1 9/2011 Earnest et al.
8,032,958 B2 10/2011 Pieta et al.
D650,153 S 12/2011 Chopak et al.
8,083,601 B2 12/2011 Speedie et al.
8,096,960 B2 1/2012 Loree et al.
8,112,835 B2 2/2012 Eirich et al.
8,141,186 B2 3/2012 Jackson et al.
8,191,188 B2 6/2012 Kaplan et al.
8,197,005 B2 6/2012 Daley et al.
8,239,984 B2 8/2012 Hopke et al.
8,269,625 B2 9/2012 Hoy et al.
D669,659 S 10/2012 Barski
8,302,225 B1 11/2012 Earnest et al.
8,321,980 B2 12/2012 Maloney et al.
D674,614 S 1/2013 Morand
8,347,432 B2 1/2013 Schmid et al.
8,365,325 B2 2/2013 Schneider et al.
8,375,486 B2 2/2013 Earnest et al.
D678,693 S 3/2013 Bergkvist
8,395,510 B1 * 3/2013 Kirk ..... G08B 25/08 340/539.12
8,398,538 B2 3/2013 Dothie et al.
8,429,771 B2 4/2013 Long et al.
8,522,375 B2 9/2013 Conrad et al.
8,539,620 B1 9/2013 Wynh et al.
D692,209 S 10/2013 Dragu
8,555,414 B2 10/2013 Davis et al.
8,561,227 B2 10/2013 Jenkins et al.
D696,486 S 12/2013 Barski
8,607,364 B2 12/2013 Barski et al.

(56) References Cited

U.S. PATENT DOCUMENTS 8,607,366 B2 12/2013 Austin
8,661,582 B2 3/2014 Sclare et al.
8,667,631 B2 3/2014 Coates et al.
8,695,133 B2 4/2014 Christensen et al.
8,726,437 B2 5/2014 Hardesty et al.
8,745,794 B1 6/2014 McDermott
8,756,731 B1 6/2014 Huttner et al.
8,769,737 B1 7/2014 Duggins et al.
8,776,265 B2 7/2014 Neveu et al.
8,777,311 B1 7/2014 Laurel et al.
8,782,831 B2 7/2014 Houston et al.
8,784,227 B2 7/2014 Speedie et al.
8,827,366 B2 9/2014 Daley et al.
8,832,880 B2 9/2014 Sheard et al.
8,845,440 B2 9/2014 Haut et al.
D715,027 S 10/2014 Daugherty
8,863,329 B2 10/2014 Sofia-McIntire et al.
D718,017 S 11/2014 Barski
8,898,833 B2 12/2014 Coates et al.
8,904,580 B1 12/2014 Christensen et al.
8,910,332 B2 12/2014 Buckson
8,942,783 B2 1/2015 Cervantes et al.
8,943,625 B2 2/2015 Gotel et al.
9,003,564 B2 4/2015 Wynh
9,020,622 B2 4/2015 Shoham et al.
D728,198 S 5/2015 Barski
D728,199 S 5/2015 Barski
9,032,963 B2 5/2015 Grissom
9,060,549 B2 6/2015 Buckson
D734,592 S 7/2015 Castillo et al.
9,119,423 B2 9/2015 Gotel et al.
9,131,734 B2 9/2015 Daugherty et al.
D741,046 S 10/2015 Pelekanou
9,155,403 B2 10/2015 Mountz et al.
D742,097 S 11/2015 Dunn
9,179,711 B2 11/2015 Krawchuk
D751,847 S 3/2016 Brown
9,392,881 B1 7/2016 Schmelzle
D780,472 S 3/2017 Behar
9,962,012 B1 5/2018 Schmid et al.
2002/0016991 A1 2/2002 Brown
2002/0100116 A1 8/2002 Richards et al.
2004/0070254 A1 4/2004 Conlon et al.
2004/0078895 A1 4/2004 Elling et al.
2005/0022284 A1 2/2005 Thach
2005/0091743 A1 5/2005 Bloemer et al.
2005/0120459 A1 6/2005 McConnell et al.
2005/0210592 A1 9/2005 Littlehorn et al.
2005/0283908 A1 12/2005 Wong et al.
2006/0025226 A1 2/2006 Nakano et al.
2006/0042013 A1 3/2006 Madsen
2006/0084514 A1 4/2006 Speedie et al.
2006/0096031 A1 5/2006 Foster
2006/0225206 A1 10/2006 Kasem
2007/0056109 A1 3/2007 Forshpan et al.
2007/0060015 A1 3/2007 Glatt et al.
2007/0061968 A1* 3/2007 Fader ..... A47D 15/008 5/494
2007/0085695 A1 4/2007 Nerurkar et al.
2007/0111809 A1* 5/2007 Bellows ..... A47D 9/02 472/118
2007/0267904 A1 11/2007 Clapper et al.
2008/0077020 A1 3/2008 Young et al.
2008/0136236 A1* 6/2008 Kincaid ..... A47D 9/02 297/260.2
2008/0141457 A1 6/2008 Forshpan et al.
2008/0196164 A1 8/2008 Calilung
2008/0217150 A1 9/2008 Chen
2008/0314665 A1 12/2008 Sanders et al.
2009/0062622 A1 3/2009 Lin et al.
2009/0064390 A1 3/2009 Beiring et al.
2009/0131185 A1 5/2009 Speedie
2009/0206642 A1* 8/2009 Raphael ..... A47D 9/02 297/217.3
2010/0044164 A1 2/2010 Thorne
2010/0201171 A1 8/2010 Velderman et al.
2010/0218299 A1 9/2010 Damir
2010/0228315 A1 9/2010 Nielsen
2010/0231421 A1 9/2010 Rawls-Meehan
2010/0257654 A1 10/2010 Waters et al.
2010/0275373 A1 11/2010 Kaplan
2010/0298742 A1 11/2010 Perlman
2010/0328075 A1 12/2010 Rahamim et al.
2011/0025915 A1 2/2011 Daban et al.
2011/0032103 A1 2/2011 Bhat et al.
2011/0078855 A1 4/2011 Buckson et al.
2011/0099719 A1 5/2011 Hardesty et al.
2011/0116549 A1 5/2011 Riddiford et al.
2011/0179546 A1 7/2011 Millette et al.
2011/0277210 A1 11/2011 Hardesty et al.
2011/0308011 A1 12/2011 Cheng
2012/0025992 A1 2/2012 Tallent et al.
2012/0083670 A1 4/2012 Rotondo
2012/0125347 A1 5/2012 Soileau et al.
2012/0216349 A1 8/2012 Kaplan et al.
2012/0297518 A1 11/2012 Aiken et al.
2012/0311762 A1 12/2012 Aiken et al.
2013/0123654 A1 5/2013 Rahamim et al.
2013/0139290 A1 6/2013 Barski et al.
2013/0165809 A1 6/2013 Abir
2013/0185867 A1 7/2013 Long et al.
2014/0059762 A1 3/2014 Bonczek
2014/0068834 A1 3/2014 Skinner
2014/0130254 A1 5/2014 Jeong
2014/0173822 A1 6/2014 Doering et al.
2014/0249382 A1 9/2014 Bhat et al.
2014/0250558 A1 9/2014 Russo
2014/0250592 A1 9/2014 Karp et al.
2014/0265480 A1 9/2014 Perrin et al.
2014/0339867 A1 11/2014 Daley et al.
2014/0345042 A1 11/2014 Morand
2015/0026886 A1 1/2015 Gangan
2015/0045608 A1 2/2015 Karp et al.
2015/0059089 A1 3/2015 Falkiner
2015/0126819 A1 5/2015 Cervantes
2015/0196137 A1* 7/2015 Zhao ..... A47D 13/105 297/260.2
2015/0250330 A1 9/2015 Mountz et al.
2015/0250419 A1 9/2015 Cooper et al.
2016/0128392 A1 5/2016 Krawchuk
2016/0165961 A1 6/2016 Karp
2016/0174619 A1 6/2016 Waters
2016/0174728 A1 6/2016 Karp et al.
2016/0310067 A1 10/2016 Heinrich et al.
2017/0043117 A1 2/2017 Karp et al.
2017/0043118 A1 2/2017 Karp et al.

FOREIGN PATENT DOCUMENTS

CA 2848529 3/2013
CA 2918029 4/2016
CN 1759897 A 4/2006
CN 101036556 A 9/2007
CN 2018085348 Y 7/2008
CN 201718870 U 1/2011
EP 617907 B1 6/1997
EP 1435810 7/2004
EP 1748711 A1 2/2007
EP 1748711 B1 1/2008
EP 2617329 7/2013
EP 2197322 B1 2/2014
EP 2292124 B1 7/2014
EP 2768345 A1 8/2014
EP 2915459 9/2015
EP 2929812 A1 10/2015
EP 2756136 8/2016
FR 2669201 A1 5/1992
GB 2312374 A 10/1997
JP 07275091 A 10/1995
JP 07289394 A 11/1995
JP 2000510022 A 8/2000
KR 1020040097883 11/2004
KR 1020040097883 A 11/2004
KR 20060019024 A 3/2006

(56) References Cited

FOREIGN PATENT DOCUMENTS

| | | | |
|---|---|---|---|
| KR | 1020060079587 | A | 7/2006 |
| KR | 20090121797 | A | 11/2009 |
| WO | 199817150 | A2 | 4/1998 |
| WO | 20090121797 | A1 | 12/2004 |
| WO | 2007062499 | | 6/2007 |
| WO | 2010098702 | A1 | 9/2010 |
| WO | 2013038248 | | 3/2013 |
| WO | 2013059625 | A1 | 4/2013 |
| WO | 2013087955 | A1 | 6/2013 |
| WO | 2013135975 | A1 | 9/2013 |
| WO | 2013188810 | A1 | 12/2013 |
| WO | 2014078442 | A1 | 5/2014 |
| WO | 2015017709 | A1 | 2/2015 |
| WO | 2015017709 | A9 | 2/2015 |
| WO | 2015078937 | | 6/2015 |
| WO | 2015143430 | A1 | 9/2015 |
| WO | 2016055946 | | 4/2016 |
| WO | 2016096518 | A1 | 6/2016 |
| WO | 2016123619 | A1 | 8/2016 |
| WO | 2016138441 | A1 | 9/2016 |

OTHER PUBLICATIONS

SNOO Bassinet, Can this High-Tech Bassinet Keep Sleep-Deprived Parents Sane?, The Wall Street Journal, http://www.wsj.com/articles/can-this-high-tech-bassinet-keep-sleep-deprived-parents-sane, Oct. 18, 2018.

Putting Baby in SNOO Sack, https://www.youtube.com/watch?v=NvTIOzWxG80, Oct. 28, 2016.

Office Action dated Aug. 22, 2016 in Australian Application No. 2012325947.

Extended European search report dated Feb. 24, 2017 in European patent application No. 14831425.5.

"Safety Standard for Bassinets and Cradles; Correction", Federal Register, vol. 78, No. 247, https://www.federalregister.gov/documents/2013/12/24/2013-30527/safety-standard-for-bassinets-and-cradles-correction (accessed Nov. 10, 2016), Consumer Product Safety Commission, Dec. 24, 2013, 1 page.

Edge Banding, Kreg Newsletter, Nov. 2014, site visited Jun. 15, 2017, availabe online <URL:http://www.kregtool.com/files/newsletters/kregplus/november14.html>.

Iron-on Edge Banding, Popular Woodworking Magazine, Sep. 19, 2008,site visited Jun. 15, 2017, available online <URL:http://www.popularwoodworking.com/projects/iron-on-edge-banding>.

"About SUID and SIDS", Centers for Disease Control and Prevention, http://www.cdc.gov/sids/aboutsuidandsids.htm (accessed Nov. 3, 2016), Last update: Oct. 3, 2016, 2 pages.

"Infant Sleep Forum Posting", http://www.sleepnet.com/infant/messages/501.html, (accessed Mar. 16, 2015), 2 pages.

"Safety Standard for Bassinets and Cradles; Correction", Federal Register, vol. 78, No. 205, https://www.federalregister.gov/documents/2013/10/23/2013-24203/safety-standard-for-bassinets-and-cradles, (accessed Nov. 10, 2016), Consumer Product Safety Commission, Oct. 23, 2013, 18 pages.

"Safety Standard for Bedside Sleepers", Federal Register, vol. 79, No. 10, https://www.federalregister.gov/documents/2014/01/15/2014-00597/safety-standard-for-bedside-sleepers, (accessed Nov. 10, 2016), Consumer Product Safety Commission, Jan. 15, 2014, 9 pages.

"SIDS and Other Sleep-Related Infant Deaths: Expansion of Recommendations for a Safe Infant Sleeping Environment", Task Force on Sudden Infant Death Syndrome, Pediatrics, vol. 128, No. 5, Nov. 2011, pp. e1341 (29 pages).

12781007.5, "European Application Serial No. 12781007.5, Examination Notification Art 94(3) dated May 5, 2015", Unacuna, LLC, 3 Pages.

AAP Task Force on SIDS, "The Changing Concept of Sudden Infant Death Syndrome: Diagnostic Coding Shifts, Controversies Regarding the Sleeping Environment, and New Variables to Consider in Reducing Risk", Peds, vol. 116, 2005, pp. 1245-1255.

Ariagno, et al., "Fewer spontaneous arousals during prone sleep in preterm infants at 1 and 3 months corrected age", Journal of Perinatology, vol. 26, 2006, pp. 306-312.

Carpenter, et al., "Sudden unexplained infant death in 20 regions in Europe: case control study", The Lancet, vol. 363, No. 9404, 2004, pp. 185-191.

Colvin, et al., "Sleep Environment Risks for Younger and Older Infants", Pediatrics, vol. 134, Jul. 2014, pp. e406-e412.

Galland, et al., "Prone versus supine sleep position: a review of the physiological studies in SIDS research", J Paediatr Child Health. vol. 38, No. 4, Aug. 2002, pp. 332-338.

Groswasser, et al., "Reduced arousals following obstructive apneas in infants sleeping prone", Pediatric Research, vol. 49, No. 3, 2001, pp. 402-406.

Horne, et al., "Effects of body position on sleep and arousal characteristics in infants", Early Human Development, vol. 69, iss. 1-2, Oct. 2002, pp. 25-33.

Horne, et al., "The prone sleeping position impairs arousability in term infants", The Journal of Pediatrics, vol. 138, No. 6, 2001, pp. 811-816.

Kato, et al., "Spontaneous Arousability in Prone and Supine Position in Healthy Infants", Sleep, vol. 29, No. 6, 2006, pp. 785-790.

L'Hoir, et al., "Risk and preventive factors for cot death in The Netherlands, a low-incidence country", Eur J Pediatr, vol. 157, 1998, pp. 681-688.

Li, et al., "Infant Sleeping Position and the Risk of Sudden Infant Death Syndrome in California, 1997-2000", Am J Epidemiol, vol. 157, No. 5, 2003, pp. 446-455.

McDonnell, et al., "Infant Deaths and Injuries Associated with Wearable Blankets, Swaddle Wraps, and Swaddling", J Pediatr., vol. 164, No. 5, May 2014, pp. 1152-1156.

Mitchell, et al., "Changing Infants' Sleep Position Increases Risk of Sudden Infant Death Syndrome", Arch Ped Adol Med., vol. 153, 1999, pp. 1136-1141.

Øyen, et al., "Combined effects of sleeping position and prenatal risk factors in sudden infant death syndrome: the Nordic Epidemiological SIDS Study", Pediatrics, vol. 100, No. 4, 1997, pp. 613-621.

PCT/US2012/061069, "International Application Serial No. PCT/US2012/061069, International Preliminary Report on Patentability With Written Opinion dated May 1, 2014", Unacuna, LLC, 4 Pages.

PCT/US2012/061069, "International Search Report and Written Opinion for International Application Serial No. PCT/US2012/061069 dated Mar. 11, 2012", 8 pages.

PCT/US2014/049253, "International Application Serial No. PCT/US2014/049253 International Preliminary Report on Patentability dated Feb. 11, 2016", The Happiest Baby, Inc., 10 pages.

PCT/US2014/049253, "International Application Serial No. PCT/US2014/049253, International Search Report and Written Opinion dated Nov. 24, 2014", Unacuna, LLC, 13 pages.

PCT/US2016/019878, "International Application Serial No. PCT/US2016/019878, International Search Report and Written Opinion dated May 6, 2016", Happiest Baby, Inc., 7 pages.

Pease, et al., "Swaddling and the Risk of Sudden Infant Death Syndrome: A Meta-analysis", Pediatrics, vol. 137, No. 6, Jun. 2016, pp. e20153275 (11 pages).

Ponsonby, et al., "Factors potentiating the risk of Sudden Infant Death Syndrome associated with the Prone Position", NEJM, vol. 329, 1993, pp. 377-382.

Shapiro-Mendoza, et al., "Trends in Infant Bedding Use: National Infant Sleep Position Study, 1993-2010", Pediatrics, vol. 135, 2015, pp. 10-17.

Tuladhar, et al., "Effects of sleep position, sleep state and age on heart rate responses following provoked arousal in term infants", Early human development, vol. 71, iss. 2, Apr. 2003, pp. 157-169.

Vennemann, et al., "Sleep Environment Risk Factors for Sudden Infant Death Syndrome: The German Sudden Infant Death Syndrome Study", Pediatrics, vol. 123, No. 4, Apr. 2009, pp. 1162-1170.

Office Action dated Mar. 24, 2017 from related Mexican Patent Application No. MX/a/2014/004648.

U.S. Appl. No. 15/055,105, filed Feb. 26, 2016, Pending.

International Search Report and Written Opinion for PCT/US2017/057055, dated Feb. 1, 2018.

Naver blog, URL: https://blog.naver.com/redtony02/30103163614.

(56) References Cited

OTHER PUBLICATIONS

International Search Report and Written Opinion for PCT/US19/191010, dated May 24, 2019.

* cited by examiner

INFANT CALMING/SLEEP-AID DEVICE AND METHOD OF USE

CROSS-REFERENCE TO RELATED APPLICATIONS

This application is a continuation of U.S. patent application Ser. No. 14/353,258, filed Apr. 21, 2014, which is a 371 of PCT/US2012/061069, filed Oct. 19, 2012, which claims the benefit of U.S. Provisional Application No. 61/549,627, filed on Oct. 20, 2011.

Each of the above applications is incorporated by reference in its entirety.

BACKGROUND

Persistent crying and poor infant sleep are perennial and ubiquitous causes of parent frustration. During the first months of life, babies fuss/cry an average of about 2 hours/day and wake about 2 to 3 times a night. One in six infants are brought to a medical professional for evaluation for sleep/cry issues.

Infant crying and parental exhaustion are often demoralizing and lead to marital conflict, anger towards the baby and impaired job performance. In addition, they are primary triggers for a cascade of serious/fatal health sequelae, including postpartum depression (which affects about 15% of all mothers and about 25 to about 50% of their partners), breastfeeding failure, child abuse and neglect, suicide, SIDS/suffocation, maternal obesity, cigarette smoking, excessive doctor visits, overtreatment of infants with medication, automobile accidents, dysfunctional bonding, and perhaps infant obesity.

Traditional parenting practices have utilized swaddling, rhythmic motion and certain sounds to soothe fussing infants and promote sleep (by reducing sleep latency and increasing sleep efficiency). "Sleep latency" is defined as the length of time between going to bed and falling asleep. "Sleep efficiency" is defined as the ratio of time spent asleep (total sleep time) to the amount of time spent in bed. Swaddling, rhythmic motion and certain sounds imitate elements of a baby's in utero sensory milieu and activate a suite of brainstem reflexes, the calming reflex. Swaddling is a method of snug wrapping with the arms restrained at the baby's sides. This imitates the tight confinement babies experience in the womb. Swaddling also inhibits startling and flailing, which often interrupts sleep and starts/exacerbates crying.

Rhythmic motion replicates the movement fetuses experience when the mother is walking. The motion stimulates the vestibular apparatus in the semicircular canals of the inner ear. A specific, rumbling low-frequency noise imitates the sound created by the turbulence of the blood flowing through the uterine and umbilical arteries. In utero the sound level babies hear has been measured at between 72 and 92 dB. Each baby has a specific and distinctive unique mix of motion and sound that most efficiently activates his or her calming reflex. This preferred mix stays consistent through the first months of life (i.e. babies who respond best to swaddling plus motion continue to respond to those modalities over time and don't abruptly switch their preference to swaddling plus sound).

The calming reflex has several constant characteristics. It is triggered by a stereotypical sensory input; produces a stereotypical behavioral output; demonstrates a threshold phenomenon (i.e. stimuli that are too mild may not be sufficient to activate a response); has a threshold that varies between individuals (i.e. is higher or lower for any given child); the threshold varies by state (e.g. fussing and crying raise the level of stimulation required to exceed threshold and bring about reflex activation).

Since the nominal level of a stimulus needed to reach the triggering threshold of the calming reflex differs from one child to the next, failure to exceed a particular child's threshold level often results in a total absence of a calming response. For example, slow smooth motion may calm one upset infant, yet be too subdued to calm another. Likewise, moderately loud sound may reach the calming threshold for one child, but not another. Once triggered, the stereotypical output of the calming reflex is a reduction of motor output and state. The intensity of sound and motion needed to trigger any particular baby's calming reflex is much greater than the levels needed to keep the calming reflex activated. "State" describes an infant's level of attention to and interaction with the environment. Infants experience six states: quiet sleep, active sleep, drowsiness, quiet alert, fussing and crying.

However, despite the convenience and availability of swaddling, rhythmic motion and sound, these methods fail to calm and promote sleep in a large portion of the infant population because they are not being applied correctly. To reduce infant crying and promote sleep parents often bring the baby into their own bed. However, this is problematic because sharing a bed with a parent has been proven to raise an infant's risk of Sudden Infant Death Syndrome (SIDS) and accidental suffocation (which has been increasing by 14% per year for approximately twenty years). The hazard of bed sharing is further elevated if the parent is extremely fatigued. Like inebriation, exhaustion reduces adult judgment and responsiveness. Over 50% of new parents report sleeping fewer than 6 hours/night, the level demonstrated in adults to simulate a level of attention impairment comparable to inebriation. For this reason, sleeping with an exhausted parent further increases the SIDS risk associated with bed sharing and further increases the suffocation risk (e.g. from accidental overlaying of the parents body over the infant's head).

Other behaviors that exhausted parents engage in to calm crying and promote sleep also directly raise the risk of SIDS and suffocation (e.g. falling asleep with the baby on a couch, placing the baby on the stomach to sleep). Medical authorities recommend parents avoid bed sharing and place sleeping babies in cribs. However, cribs are problematic. Babies sleeping supine in cribs have a higher risk of plagiocephaly (flattening of the skull), which may require expensive and inconvenient medical treatment, and may result in a permanent deformity. In addition, a crib's flat, quiet, nonmoving surface is devoid of the swaddling, rhythmic motion and sound that reduce crying, reduce sleep latency and increase sleep efficiency.

In an attempt to improve infant sleep in cribs, parents have employed several methods (prone sleeping, swaddling, rocking motion, sound), however each is problematic. For example, the prone position is associated with a 3-4 fold increased risk of SIDS. Swaddled babies can roll to the stomach position (prone), which is associated with an 8-19 fold increased risk of SIDS. Rocking motion delivery systems (e.g. swings, cradles and hammocks) all present problems. When sitting in a swing, a baby's head can roll forward and create an airway obstruction. Cradles and hammocks require parents to be the motion-powering energy source, and thus can be done for only a limited part of the sleep period. Sound delivery devices (e.g. fans, air filters, hair driers, sound machines and white noise CDs) may be cumbersome and expensive and the volume, quality or frequency profile of the sound they produce may be excessive or too different from in utero sound to be effective.

Over the past twenty years, attempts have been made to engineer technological methods to create infant calming/sleep devices to deliver sound and motion more conveniently. One such device, a motorized cradle, was designed to rock sleeping babies in an arc along the head-foot axis. This product allowed the cradle to come to rest at an angle, in a partial swing position, which resulted in multiple infant deaths. Another device, designed to simulate a car traveling at about 55 miles per hour, is comprised of 2 parts: a vibrating motor that fixes to the underside of the crib and a speaker that fixes to the sidewall. Still another device has a motorized crib that moves back and forth (about 10 cm in each direction along the head-foot axis; each swing lasting about 1.8 seconds). A sensor activates the device's motor for a limited period of time when it detects the infant's cry. Still other devices have introduced sound machines or mats that vibrate for short periods of time to be placed under the baby to encourage sleeping.

These and other current infant calming/sleep devices deliver fixed and unchangeable motion and sound. This is a problem because each baby has a different mix of sound and motion that most efficiently calms the child and promotes sleep. For example, some babies respond best to swaddling plus motion, others swaddling plus sound. Another problem with fixed motion and sound infant calming/sleep devices is that each baby has a unique level of motion and sound that induces calming and sleep most efficiently. For example, slow rocking may reduce sleep latency for one infant, yet be too subdued to do so in another infant. And, quiet sound may be sufficient to increase sleep efficiency for one baby, but not another. Also, the intensity of sound and motion that a baby needs to trigger the calming reflex is much greater than the levels needed to keep the calming reflex activated.

Still another problem with fixed motion and sound infant calming/sleep devices is that the intensity of the stimuli needed to activate the calming reflex and induce calm and sleep varies substantially as a child's state changes. For example, most fussy babies require more vigorous, jiggly motion (with rapid acceleration-deceleration) and more vigorous sound inputs (as loud as a vacuum cleaner—75 to 80 dB). On the other hand, calm, sleepy babies need less vigorous inputs. Further, current infant calming/sleep devices do not continue all night long; do not deliver optimal sound and motion for triggering the calming reflex; do not increase and decrease their sensory input in a step-wise fashion to vary the sensory input intensity to give the baby the most effective level of stimulation; lack the ability to reduce the sensory input over time to wean a baby off the stimuli as he or she ages.

Therefore, a need exists for an infant calming/sleep system that overcomes or minimizes the above-mentioned problems.

SUMMARY OF THE INVENTION

The invention generally is directed to a method for aiding calming and sleep of an infant.

In one embodiment, the invention is an infant calming/sleep-aid device that includes a main moving platform that moves in a reciprocating manner. An actuator drives the reciprocating movement of the main moving platform and a moving head platform linked to the main moving platform reciprocates in response to reciprocating movement of the main moving platform. In a preferred embodiment, at least one of a motion sensing device and a sound sensing device are, respectively, at or proximate to the moving head platform. A logic circuit links at least one of the motion sensing device and the sound sensing device to the main moving platform, whereby signals detected by at least one of the motion sensing device and the sound sensing device cause the logic circuit to modulate the movement of the main moving platform.

In another embodiment, the infant calming/sleep-aid device includes a rigid base and a main movement linkage or bearing extending from the base. The main moving platform is mounted on the main movement linkage or bearing, whereby the main moving platform is movable on the main movement linkage or bearing relative to the base. An actuation assembly that controls movement of the main moving platform about the main movement linkage or bearing relative to the rigid base includes an actuator mounted to the rigid base.

In another embodiment, the invention is a method for aiding the calming of a fussy infant or the sleep of an infant, comprising the step of moving the infant in a reciprocating manner about an axis that intersects the infant at a 90° angle to a major plane of the surface supporting the infant.

In another embodiment, the invention is an adaptive calming and sleep aid method, including the steps of moving an infant in a reciprocating manner about an axis that intersects the infant and is orthogonal to a major plane of the surface supporting the infant. At least one of a sound generated by a sound generating device and a reciprocating movement is modulated in an updating and adaptive matter by a logic circuit-controlled actuation in response to at least one of the sound of the infant and the motion of the platform.

The present invention has many advantages. For example, the system and method of the invention provides for modulation of reciprocating movement of an infant in an updating and adaptive manner. The rapidly accelerating and decelerating reciprocal motion of the device which induces the infant's head to accelerate and decelerate over a short distance in a safe and specifically controlled manner induces the infant's natural calming reflex. The device's specifically designed motion and sound, along with its adaptive control system reduce irritability during awake hours and improve infant sleep (specifically reducing irritability during periods of sleep, reducing sleep latency and increasing sleep efficiency) for babies up to about twelve months old.

DETAILED DESCRIPTION OF THE INVENTION

Figure 1:
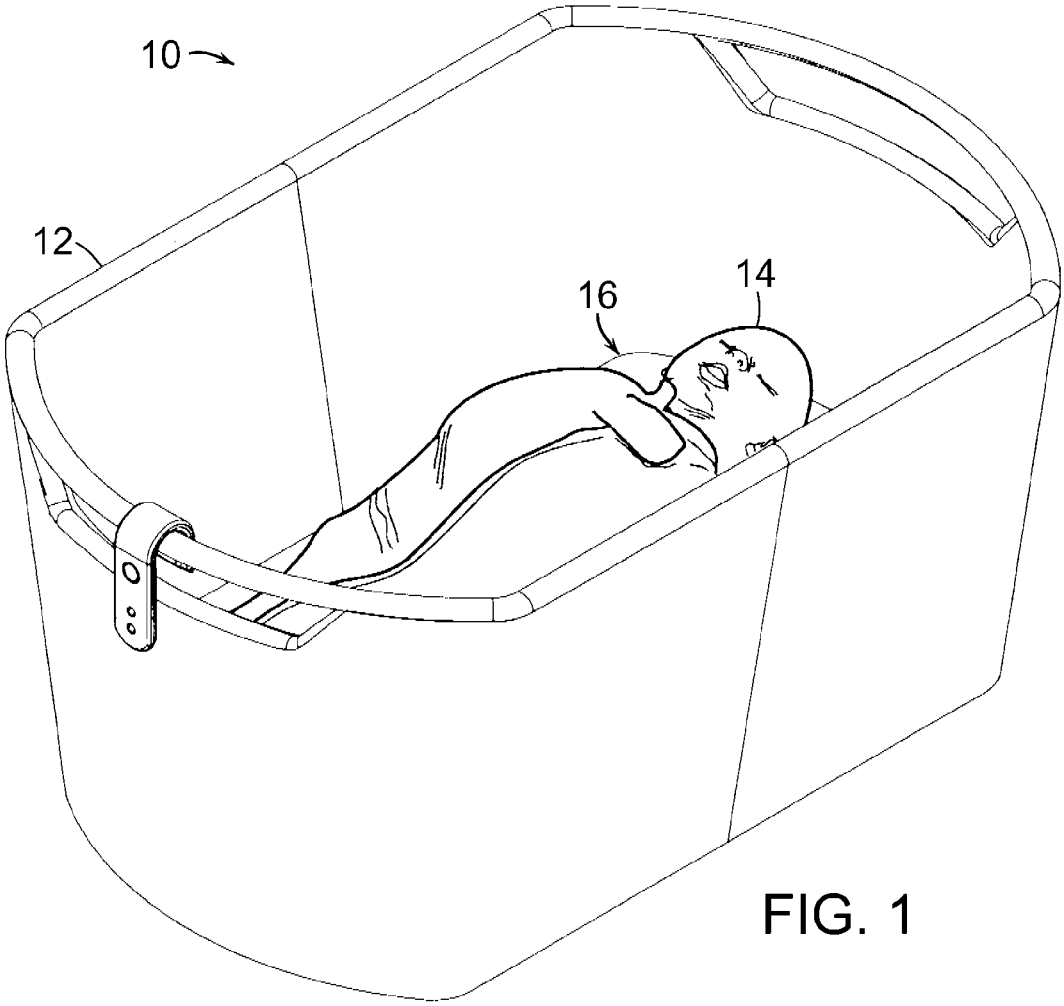
FIG. 1 is a perspective view of one embodiment of the infant calming/sleep-aid device of the invention, with a depiction of an infant asleep inside the device.
Figure 2:
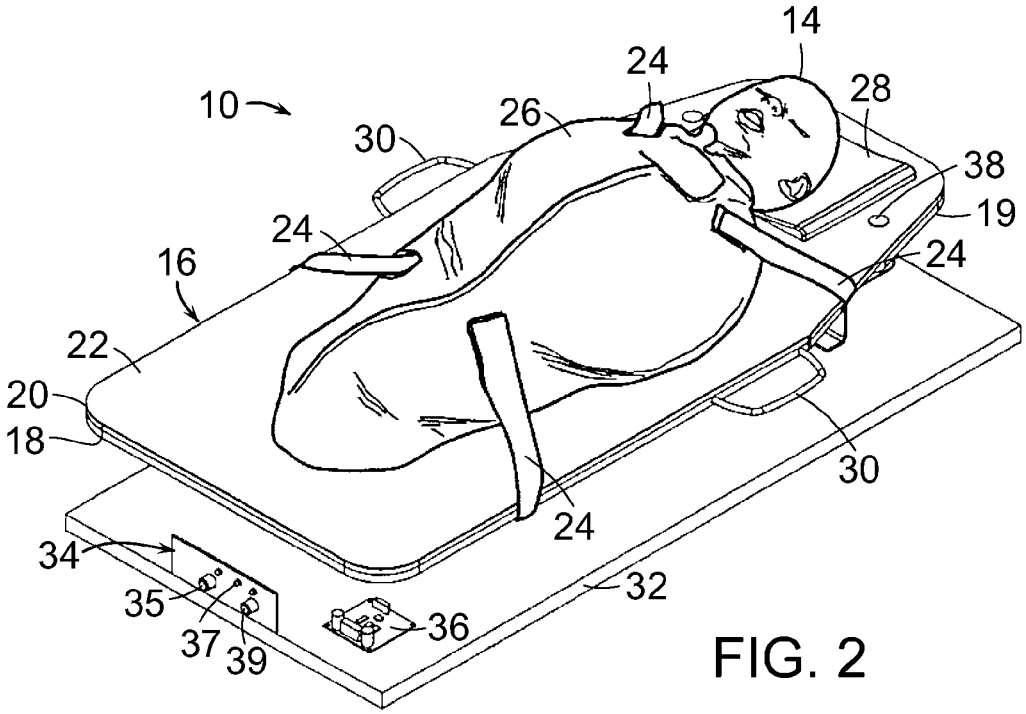
FIG. 2 is a perspective view of the infant calming/sleep-aid device of FIG. 1 with swaddle fastening straps and without an enclosure.

In one embodiment of the invention, shown in FIGS. 1 through 6, infant calming/sleep-aid device 10 includes enclosure 12 about infant 14. Enclosure 12 surrounds main moving platform 16. As can be seen in FIG. 2, main moving platform 16 includes base 18, moving head platform 19, padding 20 and cloth covering 22. Swaddle fastening straps 24 extend from main moving platform 16 for securing infant 14 in suitable swaddling clothes 26. Head pad insert 28 supports the head of infant 14. Preferably, head pad insert 28 includes a gel in order to reduce the risk of plagiocephaly. Handles 30 extend laterally from main moving platform 16. Main moving platform 16 is supported and rotatable about a main support shaft (not shown) that is fixed to rigid base 32. Control panel 34, which includes speed control knobs 35, status lights 37 and controls 39 for microphone 38. Rigid base control electronics 36, include drive electronics of infant calming/sleep-aid device 10.

Figure 3:
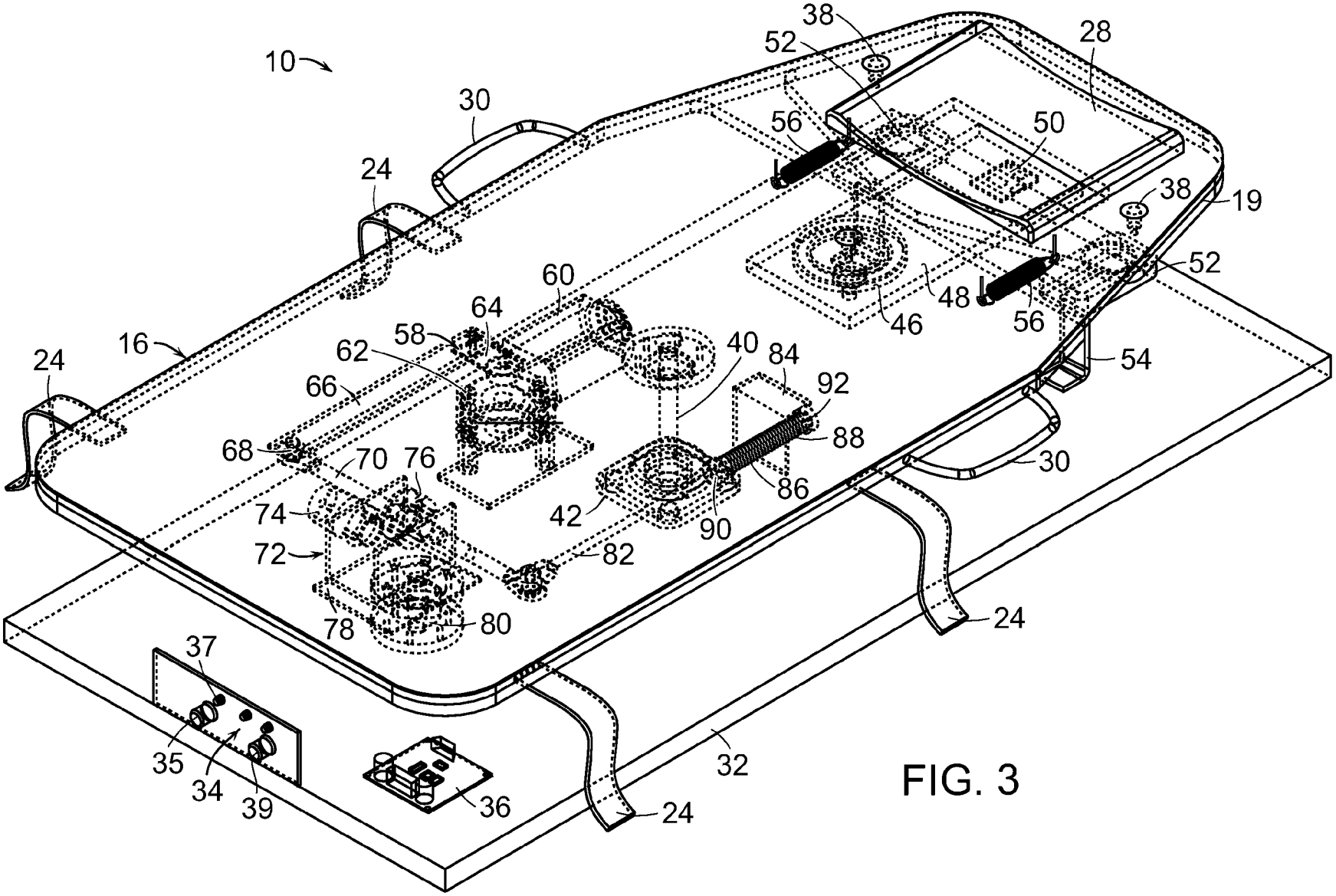
FIG. 3 is a perspective view of the infant calming/sleep-aid device of FIG. 2, showing apparatus beneath the main moving platform in broken lines.
Figure 4:
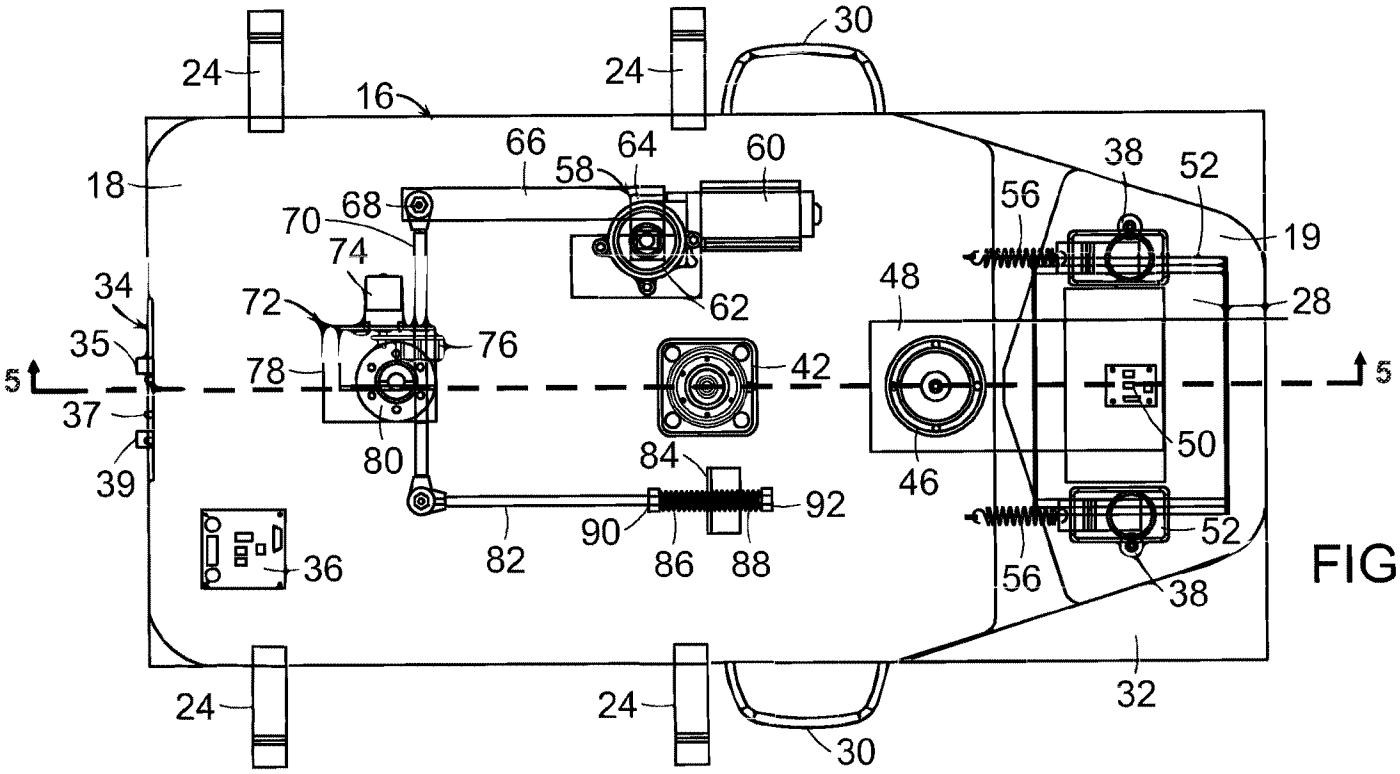
FIG. 4 is a plan view of the apparatus supporting the main moving platform of the infant calming/sleep-aid device of FIG. 3, with the rigid base and main moving platform shown in outline.
Figure 5:
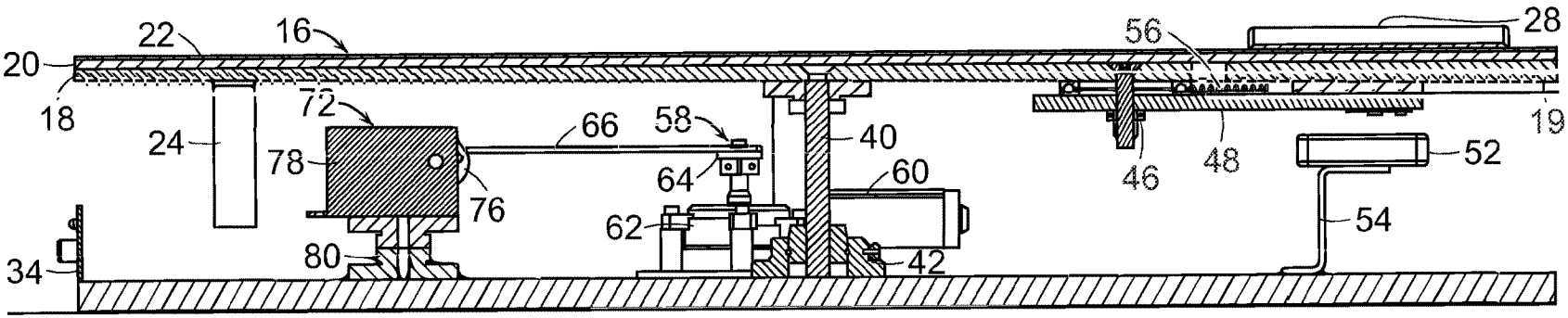
FIG. 5 is a side view of the infant calming/sleep-aid device shown in FIG. 4, taken along line 5-5.
Figure 6:
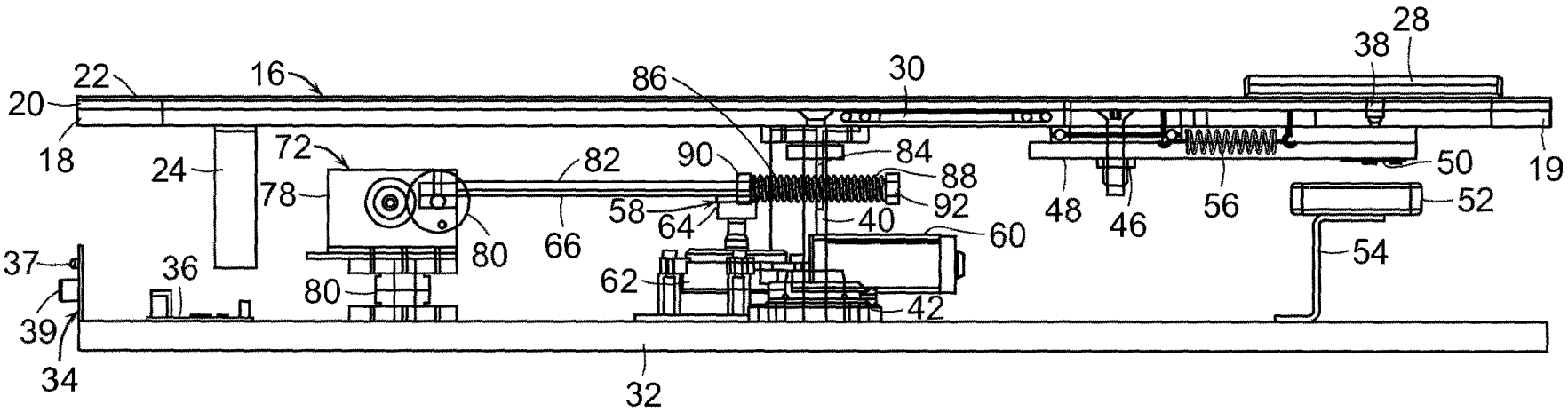
FIG. 6 is a side view of the infant calming/sleep-aid device shown in FIG. 4.

In another representative view of infant calming/sleep-aid device 10 of FIG. 2, shown in FIG. 3, main moving platform 16 is supported by main support shaft 40 at main rotation bearing 42. Moving head platform 19 supports head pad insert 28 and is rotatable about head rotation bearing 46 through arm 48 extending between head rotation bearing 46 and moving head platform 19. Motion sensing device 50, such as an accelerometer, at moving head platform 44 detects motion of moving head platform 19. Microphones 38 at moving head platform 19 detect sound emitted by the infant (not shown) when supported by infant aid sleep device 10. Speakers 52, supported by brackets 54 mounted on rigid base 18, are located directly beneath moving head platform 19. Springs 56 linking either side of moving head platform 19 to main moving platform 16 dampen motion of moving head platform 19 relative to main moving platform 16 during reciprocal motion of moving head platform 19 induced by reciprocating motion of main moving platform 16.

Reciprocating motion of main moving platform 16 about main support shaft 40 is about an axis that is orthogonal to a major plane of main moving platform 16. Reciprocating motion of main moving platform 16 is driven by actuator assembly 58.

In some embodiments, the body and the head of the infant can be out of phase. For example, at relatively slow speeds, the motion of the head of the infant can be in the same direction as that of the motion of the upper body of the infant. At relatively high speeds, the reciprocal motion of the head of the infant can be in the opposite direction as that of the upper body of the infant. In another embodiment of the invention (not shown), reciprocal motion of the head of the infant can be in some other direction, such as orthogonally relative to the plane of the main support platform.

Actuator assembly 58 includes drive motor 60 mounted to rigid base 32 and gear assembly 62 linked to drive motor 60 and also mounted to rigid base 32. Actuation of causes rotation gear assembly 62 to drive eccentric drive plate 64 about an axis normal to a major plane of rigid base 32. Eccentric drive plate 64 is linked to swing arm plate 66 of actuator assembly 58 that extends from eccentric drive plate 64 to rod end 68 of screw 70 and is pivotally mounted to rod end 68 of screw 70. Screw 70 is mounted to amplitude modulation assembly 72. Amplitude modulation assembly 72 includes amplitude modulation motor 74, nut 76, mounted on nut frame 78, which swivels on rotation bearing 80 mounted to rigid base 32. The axis of rotation of nut frame 78 on rotation bearing 80 is, like that of eccentric drive plate 64, normal to a major plane of rigid base 32. Actuation of amplitude modulation assembly 72 causes movement of screw 70 along its major longitudinal axis to thereby cause rod end 68 to become more proximate or less proximate to amplitude modulation assembly 72. Arm 82 extends from an end of screw 70 opposite to rod end 68 to elastic actuator catch bracket 84, which is mounted on base 18 of main moving platform 16. Arm 82 extends through an opening defined by elastic actuator catch bracket 84 and is linked to main moving platform 16 by springs 86, 88 held in place on either side of elastic actuator catch bracket 84 by nuts 90, 92 respectively.

Actuation of actuation assembly drive motor 60 causes rotation of eccentric drive plate 64 about an axis normal to a major plane of rigid base 32 which, in turn, causes reciprocal motion of swing arm plate 66 roughly along a major longitudinal axis of swing arm plate 66. Such reciprocal motion of swing arm plate 66 causes rod end 68 to move in a reciprocal motion from side-to-side of a major longitudinal axis of screw 70 which causes reciprocal rotation of nut frame 78 about an axis normal to major plane rigid base 18 and side-to-side motion of the opposite end of screw 70 opposite that of rod end 68 of screw 70. Such side-to-side movements of the opposite end of screw 70 causes reciprocal longitudinal movement of arm 82 extending through the opening defined by elastic actuator catch bracket 84. Resistance to such reciprocal motion of arm 82 causes alternating reciprocal compression and relaxation of springs 86, 88, which thereby causes reciprocal motion of main moving platform 16 about main support shaft 40 linking main moving platform 16 to rigid base 32.

The amplitude of reciprocal motion of main moving platform 16 about main support shaft 40 is controlled by the location of screw 70 relative to amplitude modulation assembly 72. For example, if actuation of amplitude modulation assembly 72 causes rod end 68 to become more proximate to amplitude modulation assembly 72, the side-to-side motion of the opposite end of screw 70 will become greater, thereby causing the amplification of reciprocal motion of main moving platform 16 about main support shaft 40 to increase. Conversely, actuation of amplitude modulation assembly 72 to cause rod end 68 of screw 70 to become more remote from amplitude modulation assembly 72 will diminish the side-to-side motion of opposite end of screw 70, thereby reducing the amplitude of reciprocal motion of main moving platform 16 about main support shaft 40.

Reciprocal motion of main moving platform 16 causes a delayed reciprocal motion of moving head platform 44 about head rotation bearing 46. The reciprocal motion of moving head platform 44, although delayed, has greater amplitude about main support shaft 40 because of the rotation of moving head platform 44 about head rotation bearing 46. However, the amplitude of reciprocal motion of moving head platform 44 about head rotation bearing 46 is dampened by springs 56. Nevertheless, the reciprocal motion of main moving platform 16 and moving head platform 44 about main support shaft 40 is measured by motion sensing device 50 at moving head platform 44. Measurements by motion sensing device 50 are relayed back to control panel 34 and rigid base control electronics 36 which, alone, or optionally, in combination with external computer software programming, modulate actuator assembly drive motor 60 and amplitude modulation motor 74. Motion detection by motion sensing device 50 can also, optionally, modulate computer programming to affect selection and volume of sounds emitted by speakers 52. Microphones 38, in addition, or optionally, receive acoustical signals that can be fed back through rigid base control electronics 36 or/and control panel 34 to software, either on-board or remote from infant calming/sleep-aid device 10, that further modulates actuator assembly drive motor 60, amplitude modulation motor 74 and/or sounds emitted from speakers 52. Algorithms associated with modulation of actuator assembly drive motor 60, amplitude modulation motor 74 and speakers 52 will be more fully discussed below.

In one embodiment, the device allows for a reciprocating motion at 0.5-1.5 cps of 2" excursions, but if the baby is fussy the device responds by delivering a smaller excursion (e.g. <1") at a faster rate (2-4.5 cps). This fast and small motion delivers the specific degree of acceleration-deceleration force to the semicircular canals in the vestibular mechanism of the inner ear that is required to activate the calming reflex.

Also, the reciprocating motion typically has a maximum amplitude of less than one inch during the rapid phase of motion (2-4.5 cps), further ensuring safety of the infant.

Figure 7:
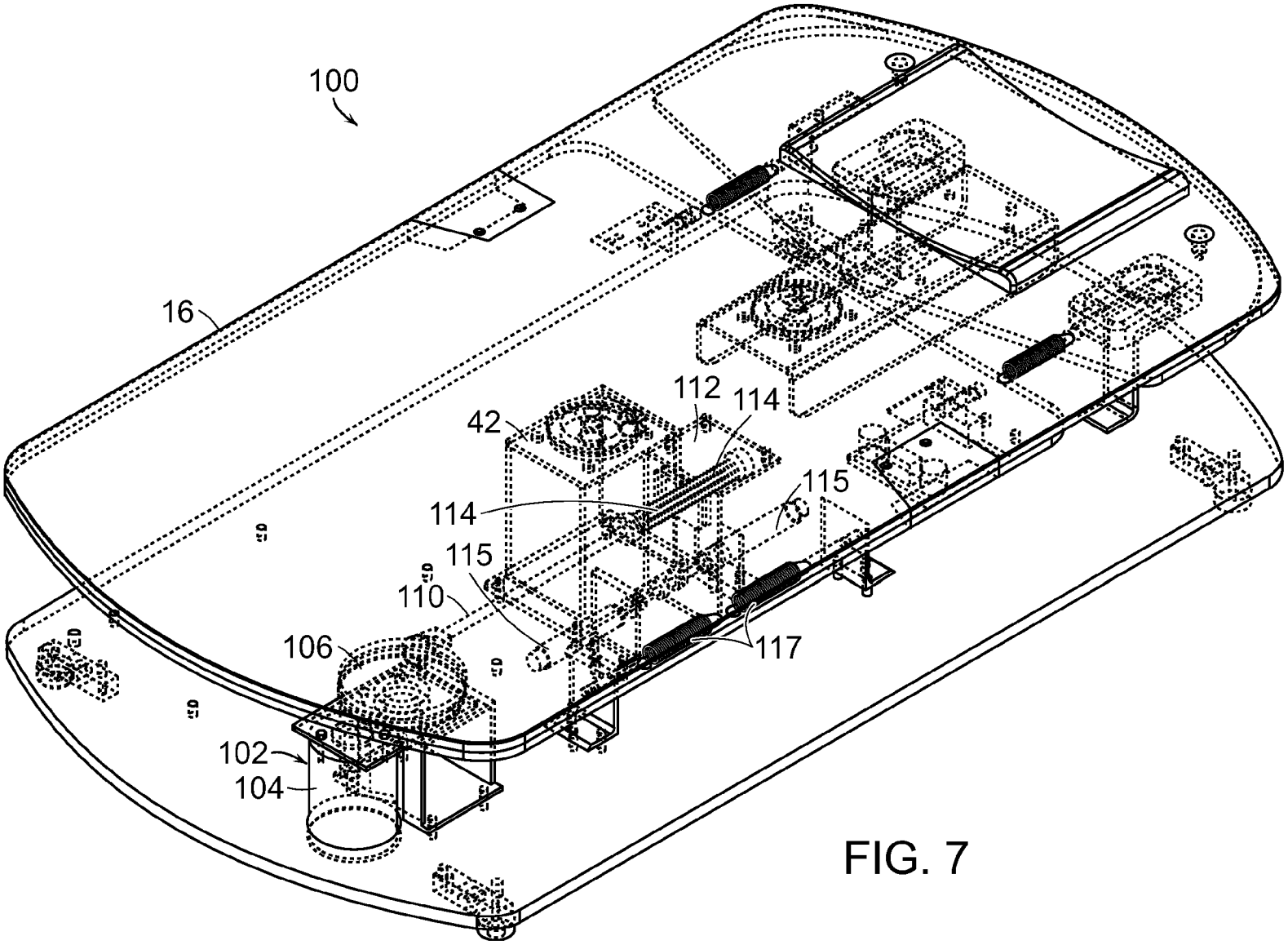
FIG. 7 is a perspective view of yet another embodiment of the calming/sleep-aid device of the invention, showing components of the device beneath the main moving platform in broken lines.
Figure 8:
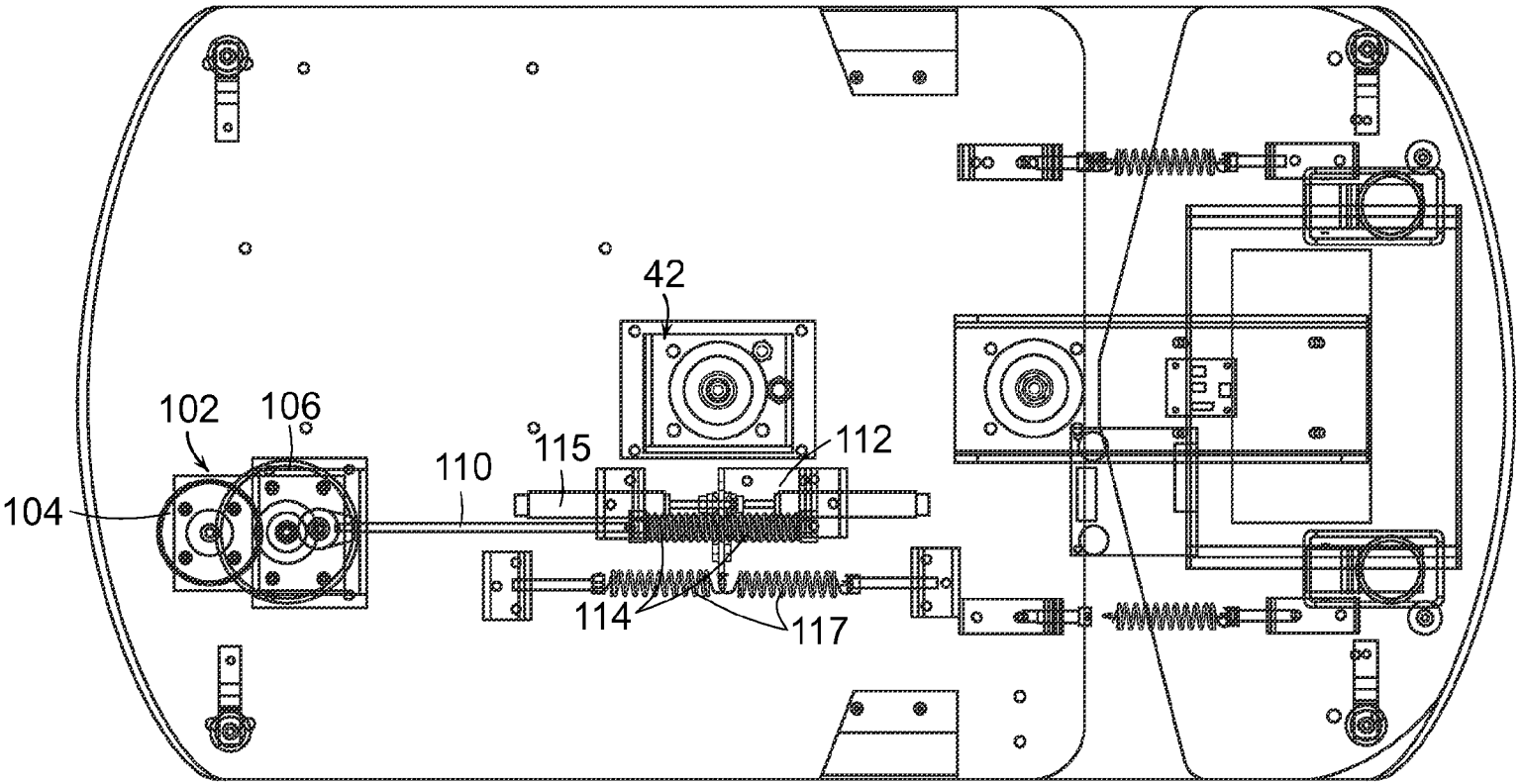
FIG. 8 is a plan view of the apparatus supporting the main moving platform of the calming/sleep-aid device of FIG. 7, with the rigid base and main moving platform shown in outline.
Figure 9:
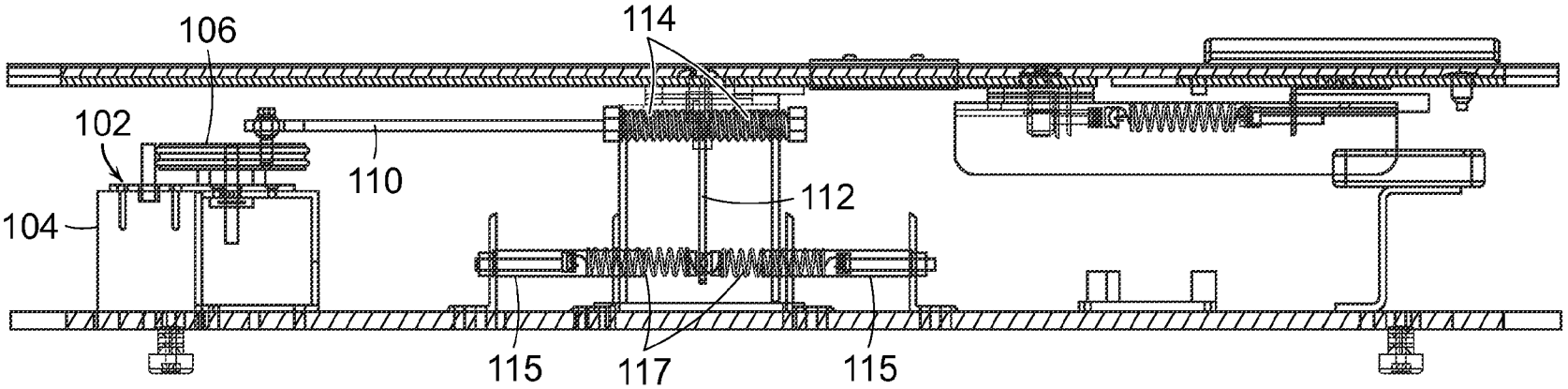
FIG. 9 is a side view of the embodiment of the device shown in FIG. 7.

In another embodiment, shown in FIGS. 7 through 9 calming/sleep-aid device 100 includes actuator assembly 102, which substitutes for actuator assembly 58 of the embodiment shown in FIGS. 2 through 6. Specifically, as shown in FIGS. 7 through 9, drive motor 104 of calming/sleep-aid device 100 is linked to bearing 106, which is, in turn, leads to the eccentric drive plate 108. Eccentric drive plate 108 is connected to push/pull rod 110 that extends through an opening defined by elastic actuator catch bracket 112. Springs 114 about push/pull rod 110 link push/pull rod 110 to main moving platform 16 through elastic actuator catch bracket 112. Springs 114 are series elastic actuator push-springs; they transfer force from actuator assembly 102 to catch bracket 112. Balancing dampers 115 beneath push/pull rod 110 dampen the motion of moving platform 16. Springs 117 are pull-balancing springs; they pull on bracket 112 in parallel with balancing dampers 115 to create the desired smooth sinusoidal motion of moving platform 16 at low frequencies and the rapid accelerating motion at high frequencies.

Actuation of drive motor 104 causes reciprocal longitudinal movement of push/pull rod 110 through the opening defined by elastic actuator catch bracket 112 and translates that reciprocal movement into reciprocal motion of main moving platform 16 about main rotation bearing 42, as does reciprocal motion of arm 82 through elastic actuator catch bracket 84 of the embodiment shown in FIGS. 2 through 6. Other components of the embodiments shown in FIGS. 7 through 9 operate in the same manner as those of infant calming/sleep-aid device 10 represented in FIGS. 2 through 6.

Figure 10:
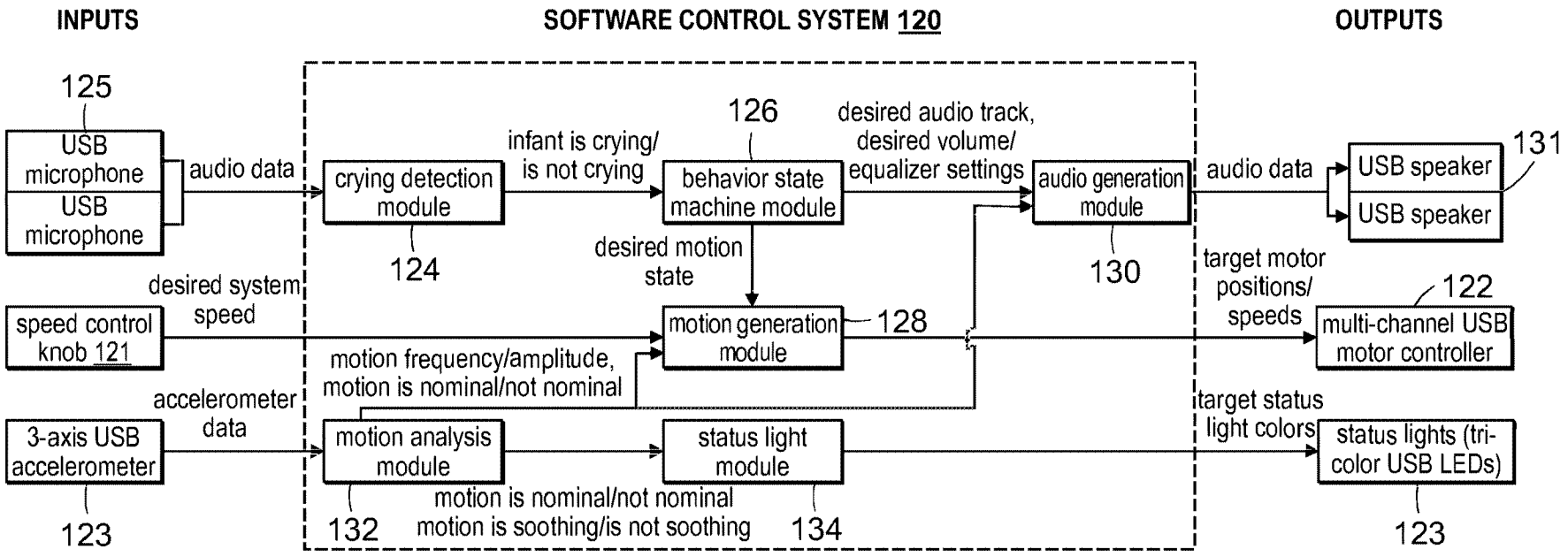
FIG. 10 is a schematic representation of one embodiment of a software control system of the invention, along with inputs and outputs of the software control system.

As shown FIG. 10, software control system 120, processes inputs from microphones and generates outputs to speakers represented in FIGS. 2 through 9, also processes inputs from speed control knob 121, also shown in FIGS. 2 through 9, and from a three-axis USB accelerometer 123, represented as motion sensing device in FIGS. 2 through 9. In addition, software control system 120 generates an output signal to multichannel USB motor controller 122, which controls actuator assembly drive motor 60 (not shown) and amplitude modulation motor 74 (not shown) or, alternatively, as shown in FIGS. 7 through 9, drive motor 104 (not shown). Status lights, such as tricolor USB DEs 121, are represented as lights 37 in FIGS. 2 through 9. Modules of software control system 120 can be located on-board or remotely from the embodiments of infant calming/sleep-aid devices 10, 100 shown in FIGS. 2 through 9. The modules include a crying detection module 124 that receives data from microphones 125, represented at microphones 38 in FIGS. 2 through 9, and relays to a behavior state machine module 126 whether or not an infant on infant calming/sleep-aid device is crying or not crying. Depending upon the input received by behavior state machine module 126, output signals will control motion generation module 128 or audio generation module 130. Actuation of motion generation module 128 will modulate the actuator assemblies of the embodiments shown in FIGS. 2 through 9. Alternatively, or in addition, output signals from behavior state machine module 126 will modulate generation of audio data output from audio generation module 130 to speakers 131, represented as speakers 52 in FIGS. 2 through 9.

Data received from accelerometer 123 is processed by motion analysis module 132 to thereby modulate the actuator assembly through motion generation module 128 and/or audio generation module 130 to thereby control the actuators assemblies or speakers, respectively. In addition, motion analysis module 132 controls status light module 134 to alert, through the status lights, whether motions of the main moving platform and the head platform are nominal or not nominal, or alternatively, through feedback, soothing or not soothing to the infant. "Nominal", as that term is defined herein, refers to any and all motion for which the filtered acceleration signal does not exceed a specified, or predetermined maximum motion threshold for a specific length of time. The process by which the motion analysis module classifies motion as nominal or not nominal is detailed in FIG. 12 and in the accompanying text below.

In one embodiment the rate of the reciprocating rotation is in a range of between about two and about four and one-half cycles per second and an amplitude of the reciprocating motion at a center of a head of the infant is in a range of between about 0.2 inches and about 1.0 inches. In anther embodiment, the rate of reciprocating motion is in a range of between about 0.5 and about 1.5 cycles per second and an amplitude of the reciprocating rotation at a center of the head of the infant is in a range of between about 0.5 inches and about 2.0 inches.

The software weans the infant off the device by incorporating the infant age as a variable used by the behavior state module control system, wherein modulation is further controlled by at least one of the weight of the infant, the age of the infant, and the duration of the detected sounds made by the infant.

Figure 11:
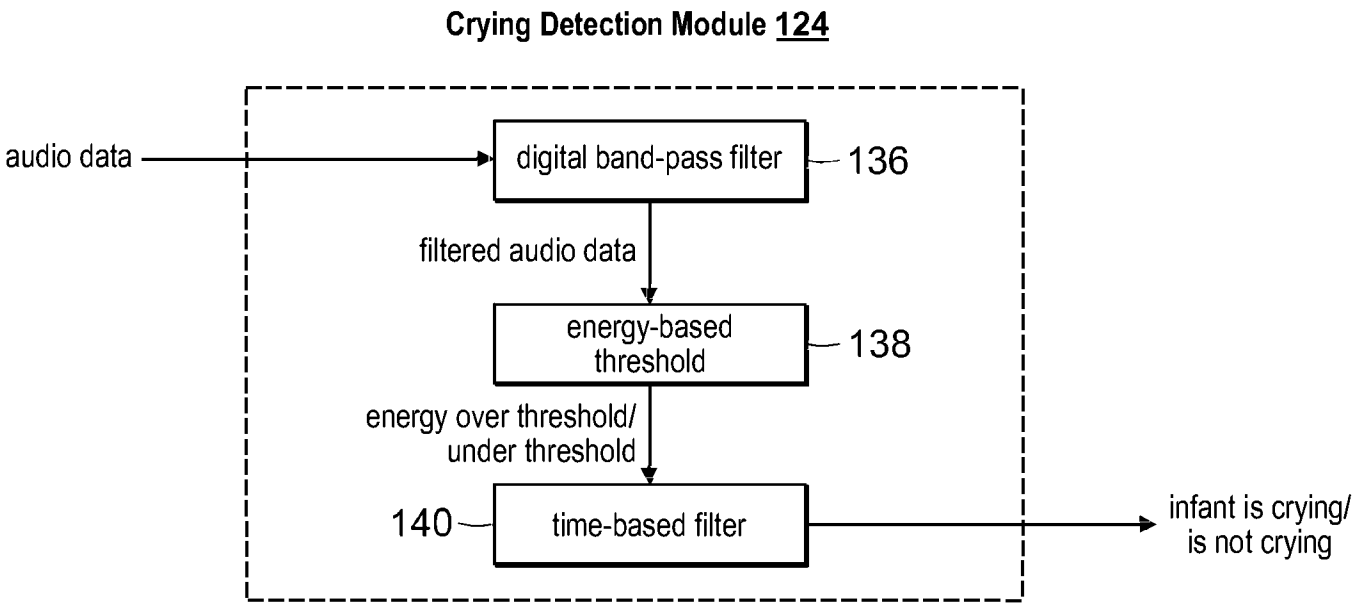
FIG. 11 is a schematic representation of one embodiment of a crying detection module of the invention.

Referring to FIG. 11, crying detection module 124 receives audio data from the microphones of infant calming/sleep-aid devices 10,100, which is processed through digital band-pass filter 136 to generate filtered audio data. Energy-based threshold 138 receives filtered audio data to determine whether the audio energy is over threshold or under threshold. Time-based filter 140 receives data from energy-based threshold 138 to provide an indication as to whether the infant is crying or not crying. The information, as discussed above with respect to software control system 120 (FIG. 10), is received from crying detection module 124 by behavior state machine module 126 that will then modulate either motion generation module 128 or audio generation module 130.

Figure 12:
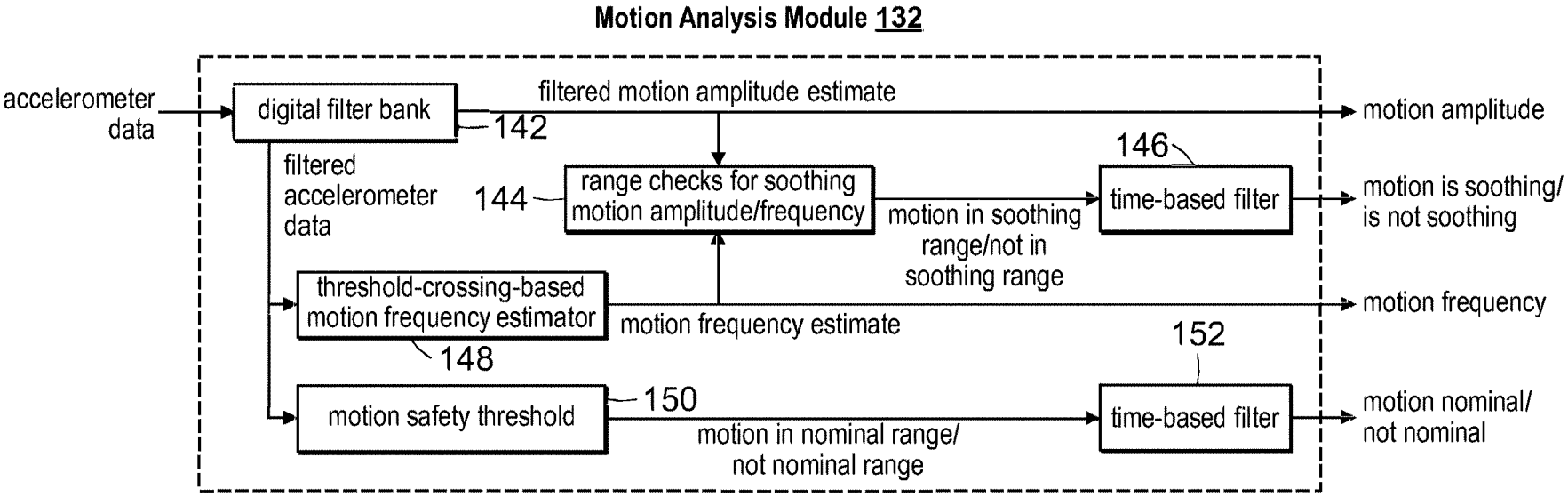
FIG. 12 is a schematic representation of one embodiment of a motion analysis module of the invention.

Motion analysis module 132, shown and represented in more detail in FIG. 12, receives a signal from the motion sensing device of infant calming/sleep-aid devices 10, 100, at digital filter bank 142. Digital filter bank 142 filters the signal to generate a filtered motion amplitude estimate that is used as input to motion generation module 128 (FIG. 10). In addition, the filtered motion amplitude estimate passes through a range check 144 to determine whether the motion is within a soothing or known soothing range. Time-based filter 146 receives data from range check 144 to provide an indication as to whether a motion is soothing or not soothing. Filtered motion sensor, or accelerometer, data from digital filter bank 142 also passes through threshold crossing-based motion frequency estimator 148. Outputted data from threshold-crossing-based motion frequency estimator 148 passes through range check 144 for indicating whether the motion is or is not soothing, and also provides input to motion generation module 128 (FIG. 10). Filtered accelerometer data from digital filter bank 142 also is processed to determine whether or not the acceleration exceeds a specific maximum motion threshold 150 and, depending on the result, processes that data through time-based filter 152 to provide an indication as to whether the motion is nominal or not nominal. This indication as to whether the motion is nominal or not nominal is used as input to motion generation module 128 (FIG. 10), and is additionally used to control status lights 37 (FIG. 2) via status light module 134 (FIG. 10).

Figure 13:
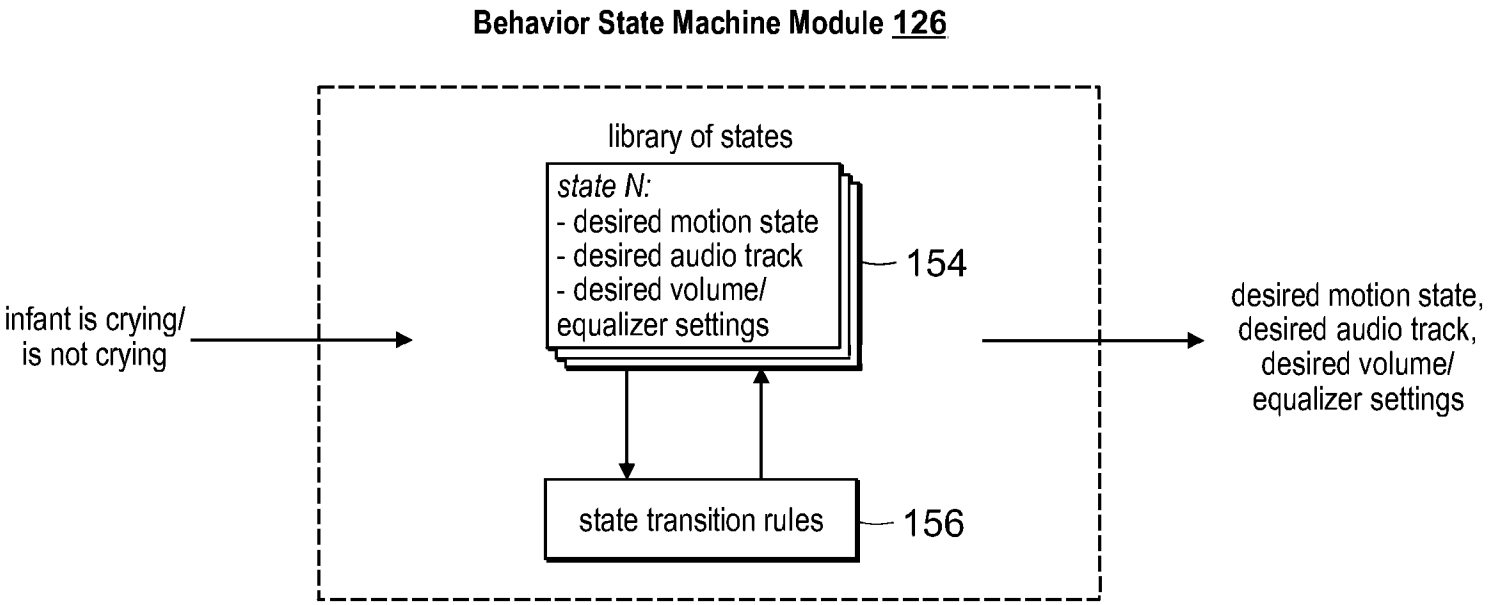
FIG. 13 is a schematic representation of one embodiment of a behavior state machine module of the invention.

As can be seen in FIG. 13, behavior state machine module 126 receives information from crying detection module 124 (FIG. 11) as to whether the infant is in a state of crying or not crying. This information is used by the state machine's state transition rules 156 to select an active state from a library of states 154, thereby outputting a desired motion state, a desired audio track and/or desired volume/equalizer settings to audio generation module 130 (FIG. 10).

Figure 14:
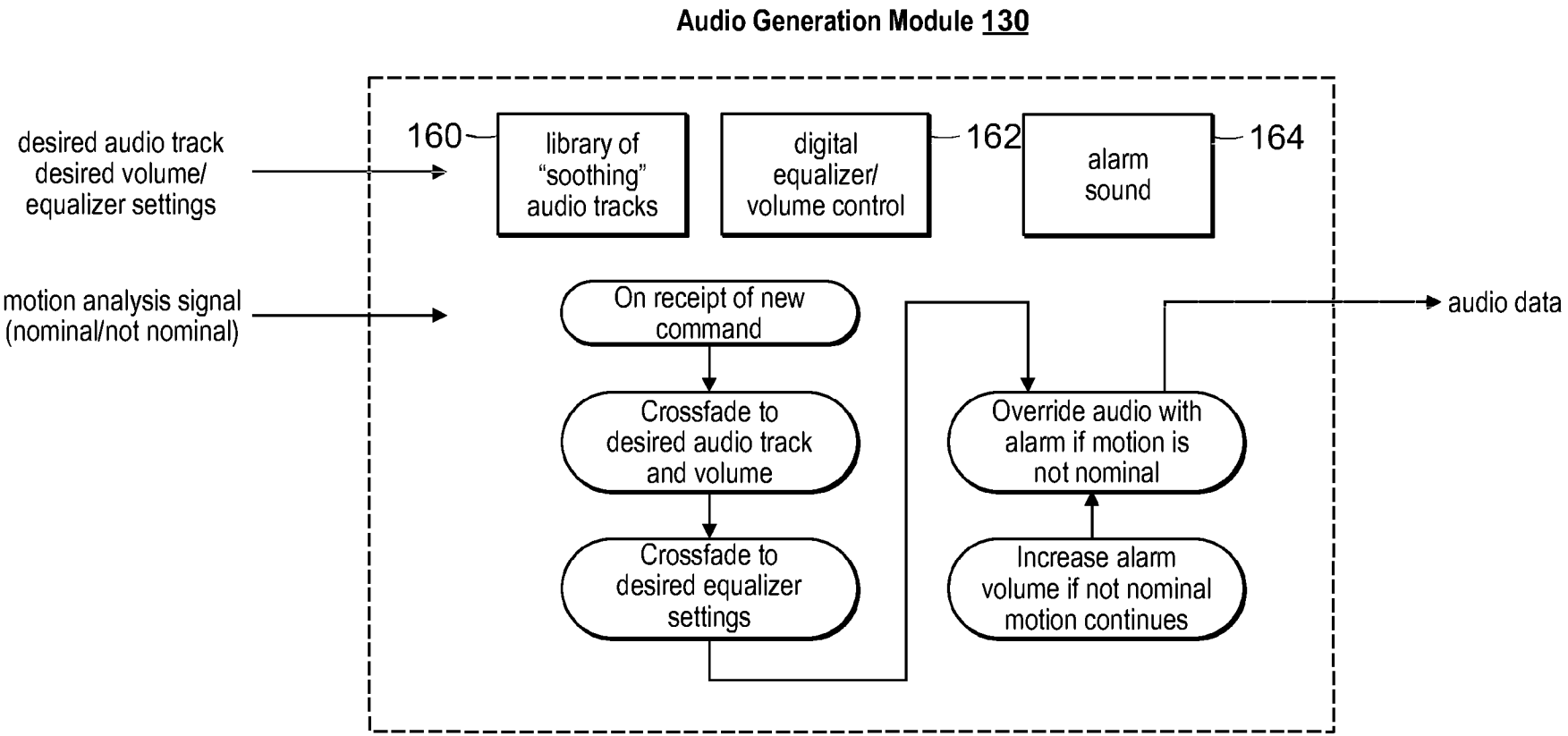
FIG. 14 is a schematic representation of one embodiment of an audio generation module of the invention.

Audio generation module 130, represented in FIG. 14, receives signals of a desired audio track and desired volume/equalizer settings from behavior state machine module 126 (FIG. 10) and signals of motion analysis, specifically, whether the motion is nominal or not nominal, from motion analysis module 132 (FIG. 10). Audio generation module 130 includes a library of "soothing" audio tracks 160, a digital equalizer/volume control 162 and alarm sound 164. Upon receipt of a new command from motion analysis module 132 (FIG. 10), audio generation module 130 will cross-fade to a desired audio track and volume, and cross-fade to desired equalizer settings. If the motion is not nominal, then an alarm signal will be output to override the audio signal with an alarm. The audio signal from the audio generation module is output to the speakers of infant calming/sleep-aid device 10, 100.

At baseline, the audio generator will produce an output of a low-pitch, rumbling sound at about 65 dB to about 70 dB. Upon receipt of a new command from crying detection module 124 (FIG. 11), audio generation module 130 will cross-fade to a more high pitched audio track and louder volume, at about 75 dB to about 80 dB.

Figure 15:
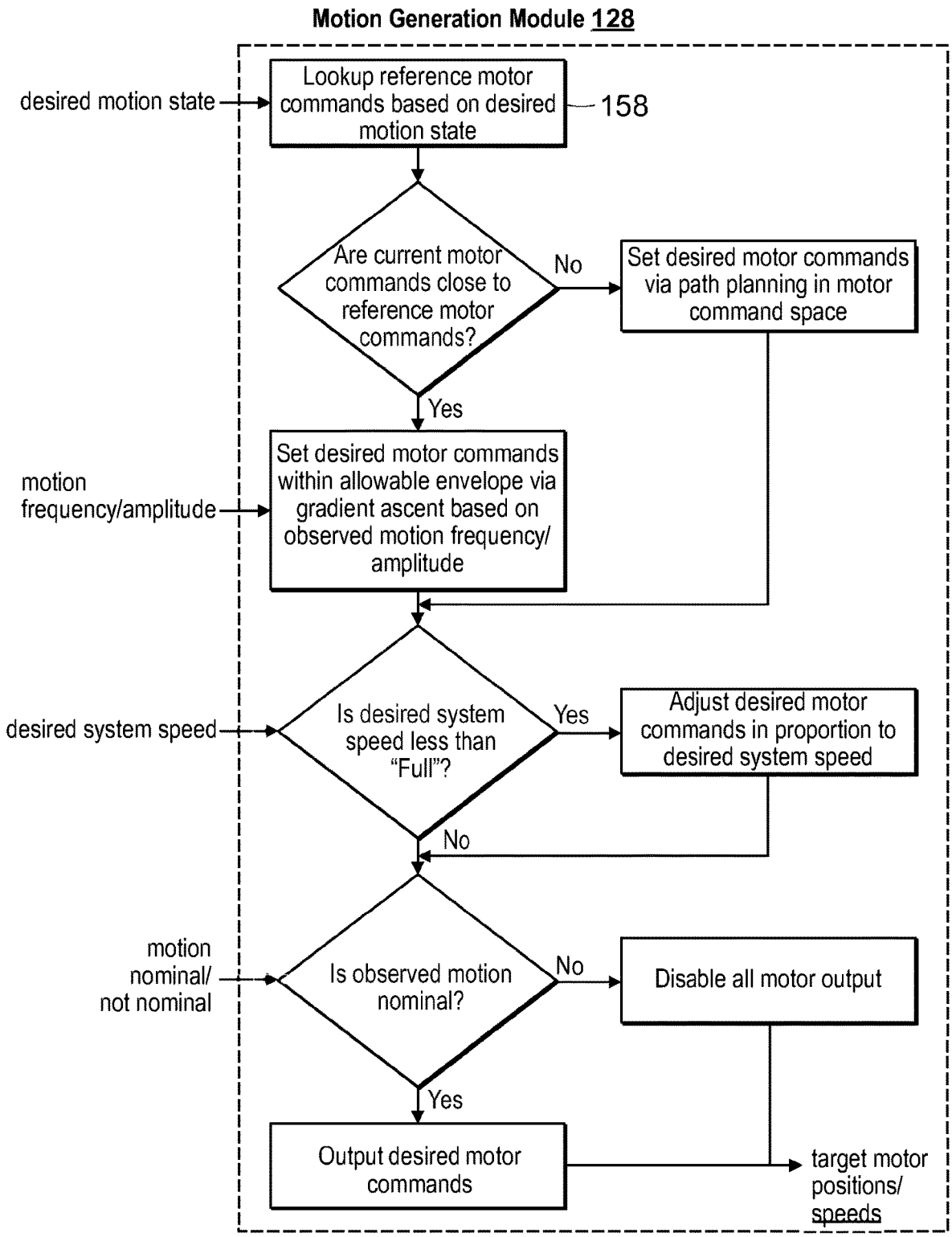
FIG. 15 is a schematic representation of a motion generation module of the invention.
Figure 16:
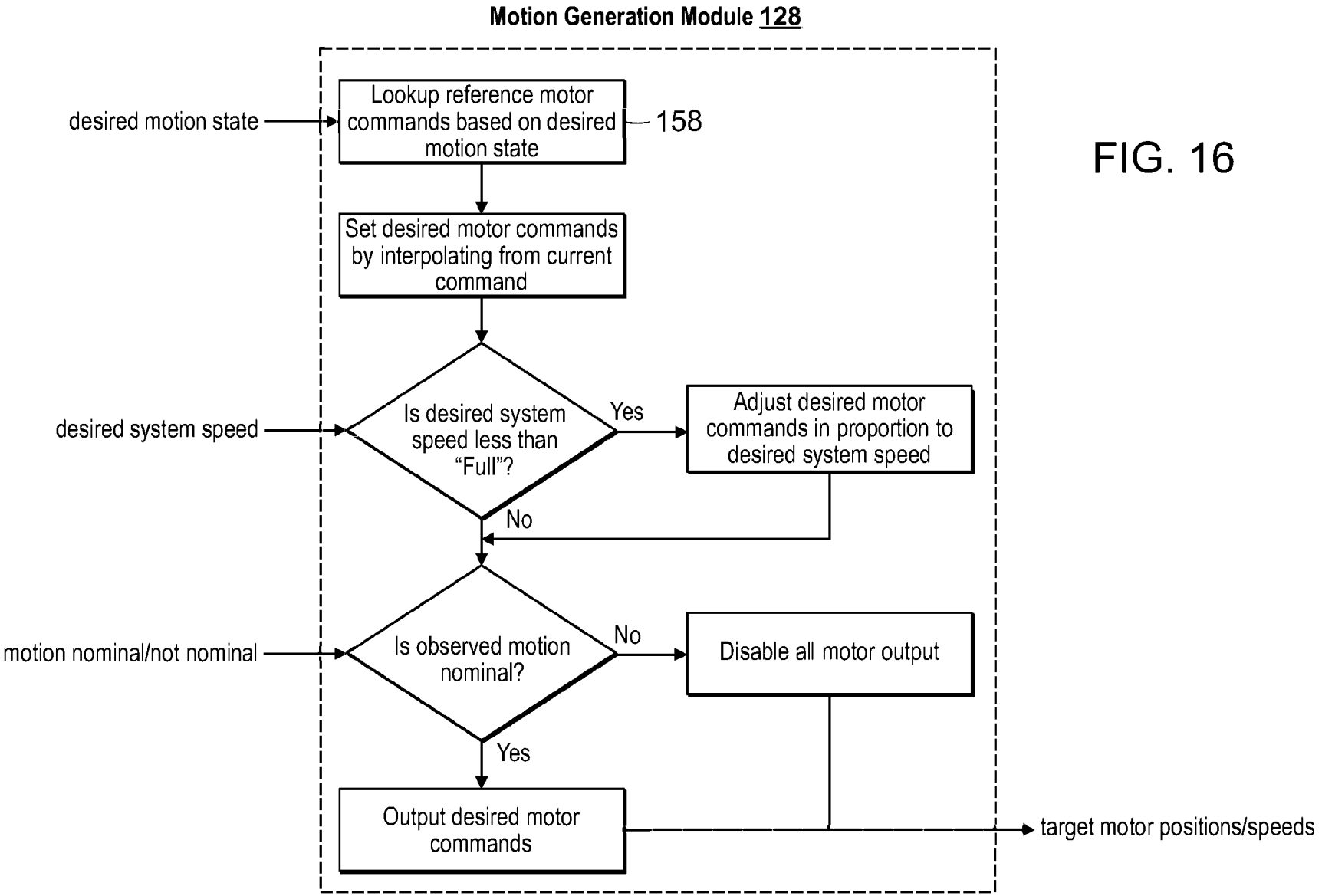
FIG. 16 is a schematic representation of a motion generation module of the invention.

Two variations of motion generation module are represented in FIGS. 15 and 16. In the first embodiment, shown in FIG. 12, motion generation module 128 receives a desired motion state input from behavior state machine module 126 (FIG. 10), a motion frequency/amplitude signal from motion analysis module 132 (FIG. 10), a desired system speed signal from speed control knob 121 (FIG. 10), and a signal as to whether a motion is nominal or is not nominal. The "desired system speed" is the setting of speed control knob 121, whereby the operator can limit the motions allowed by infant calming/sleep-aid device 10, 100. The desired motion state signal goes to lookup within motion generation module 128, which outputs a reference motor command based on a desired motion state. If the currently-active motor commands are close to the reference motor commands, then the motor commands are actively adjusted within an allowable envelope via a gradient ascent based on observed motion frequency and amplitude. If the current motor commands are not close to the reference motor commands, then the motion generation module will set desired motor commands via path planning in a motor command space. "Path planning" transitions motor settings to desired motor settings by inserting intermediate motor settings as necessitated by nest dynamics to ensure that motion stays in a desirable range during transition. If the desired system speed is less than "full," then a signal is sent to adjust the desired motor commands in proportion to the desired system speed. "Full" is the fully-on position of the knob, and means that infant calming/sleep-aid device 10, 100 is not being limited by this knob and is allowed to perform all of the motions it determines to be relevant. If speed control knob 121 is turned down from "full," motions of infant calming/sleep-aid device 10, 100 start to become constrained, so speed control knob 121 acts as an operator to override the normal motion behavior of infant calming/sleep-aid device 10, 100. If not, then a comparison is made as to whether the observed motion is nominal. If it is not, then motor output is disabled. If it is nominal, then an output signal of desired motor commands is given to target motor positions and speeds of the actuator of the multichannel USB motor controller.

In an alternative embodiment of motion generation module 128, shown in FIG. 16, there is no receipt by the module of signals related to motion frequency and amplitude. Therefore, it is only necessary to set desired motor commands by interpolating from a current command based on a look up table of motor commands based on a desired motion state in response to receiving a signal with respect to the desired motion state. All of the components of motion generation are the same as represented in FIG. 15.

EXPERIMENTAL SECTION

Materials

Two versions of the infant calming/sleep-aid device as shown in FIGS. 2 through 9 of the invention were created, with microphones to detect infant crying, motion and sound actuators, a swaddling system to keep the baby in optimal position and a gel pad to reduce the pressure on the back of the skull that predisposes to plagiocephaly. The device also contained a logic board to accomplish two tasks; deliver staged interventions of specially engineered sound and to deliver motion created by two linked platforms attached to a motor and rod actuator (as well as a series of springs and dampeners to modulate the activity.) These platforms acted in a reciprocating manner about an axis that intersected the infant and was orthogonal to a major plane of the surface supporting the infant to provide a motion that varies from slow smooth rocking (0.5-1.5 cps) to keep babies calm and promote sleep . . . ramping up to a faster, smaller, "jiggly" motion (2-4.5 cps) with a more "spiked" waveform to deliver a sufficiently abrupt acceleration-deceleration action to stimulate the vestibular mechanism of the inner ear, trigger calming reflex and soothe the baby when she cried (head rocking back and forth in excursions of less than 1 inch). The sound in the device was also designed to respond to the baby's upset by starting a specially engineered loud, harsh and high pitched and then stepping down to quieter, lower pitched white noise over several minutes. The device was specifically designed to gradually reduce ("wean") the intensity of the sound and motion over several months.

The device worked in the following way:

The baby was placed in a swaddling sack (with arms in or out) attached to the mattress of the device and securely laid on his/her back. The device produced a baseline level of low pitched, rumbling noise at approximately 65 dB and baseline motion of a smooth, side-to-side rocking (2 inch excursions to either side). When the baby cried for more than −10 seconds, the device responded by playing a specially engineered sound that was harsher, higher pitched, more multi-frequency (75-80 dB) to mimic the intensity of the sound that the baby heard inside the mother's uterus prenatally. (This sound can be measured in situ at up to 92 dB.) If the crying continued another −10 seconds (despite the sound), the motion accelerated to a faster, more jiggly action of the head (2-4.5 cps, but no more than 1 inch head excursions to either side). The combination of fast movements delivered with sufficient vigor, the harsh loud sound, and the secure swaddling sack all worked together to activate the calming reflex, in the majority of irritable babies and inducing either calmness or sleep. The device responded to the baby's cry in a step-wise fashion-gradually increasing sound and then motion-to a maximal level. Once the baby was calmed the motion and sound of the device was gradually reduced in a specific, step-wise fashion back to the baseline activity.

Subjects

The device was tested on over twenty babies (12 girls, 10 boys) were in the device. The babies ranged from 5 weeks to 6 months of age. Their weights ranged from 8 pounds to 18 pounds.

Methods and Procedures

The subjects were tested to record their resting and sleeping in the device. The tests usually began when the baby was hungry and tired (immediately before their usual naptime). The parents were introduced to the device and given a brief demonstration of how it worked. We recorded when the baby last fed and napped and then put the baby in the swaddling sack and placed the infant in the device. We observed and videotaped the session. In addition, we collected data from 3 accelerometers and a device-mounted camera to detect the vigor of activity and measure the exact excursions of the baby's head. We started each test with the device set at its lowest level for sound and motion. We observed as the device responded to the baby's cries. We allowed the device to quickly advance through each of its stages as the cries escalated. Once the baby was calmed, the device's motion would slow, in a stepwise fashion, and the loudness and pitch of the sound would decrease, in a stepwise fashion. We repeated this format 2-4 times during our sessions with each of the subjects. The first set of studies was done using a prototype with a dual motion actuator and the second set of studies was done with a prototype with a single motion actuator.

Results

As shown in the attached table, during twenty-one tests, 19 babies were either significantly calmed or put to sleep by our device (absence of calming was due to hunger). Most calming and sleep occurred within 2 minutes of placing the baby in the device.

We hypothesized that a device could be built that responded to the baby's needs, such that an infant's upsets would be soothed by vigorous stimulation to activate the calming reflex, followed by a diminution of those stimuli to help keep the calming reflex turned on and sustain the baby in a calm state and/or promote sleep, i.e., reducing sleep latency and increasing sleep efficiency. "Sleep latency" is defined as the length of time between going to bed and falling asleep. "Sleep efficiency" is defined as the ratio of time spent asleep—total sleep time to the amount of time spent in bed.)

| Patient/Baby Name | Test Date | Baby's Age | Baby's Weight | No. of times baby wakes during the night | Time since last nap | Time since last feeding | Calmed or put to sleep |
|---|---|---|---|---|---|---|---|
| Candace/Dennielle | | 13 weeks | 14.11 lbs | 1-2 times | | | Calmed |
| Amanda/James | | | | | | | Calmed |
| Jenn/MacKienze | | | 13.5 lbs | 2 times | | | Calmed |
| Sarah/Sloane | Oct. 12, 2011 | 5 weeks | | 5-6 times | | | Sleep |
| Sheela/Julia | | | 9.5 lbs | 3-4 times | | | Calmed |
| Sally/Elise | Mar. 5, 2012 | 7 weeks | 8.1 lbs | 2-3 times | 2.0 hours | 10 minutes | Sleep |
| Emily/Reese | Mar. 5, 2012 | 7 weeks | 8.3 lbs | 3-4 times | 1.5 hours | 30 minutes | Sleep |
| Jackie/Drew | Mar. 6, 2012 | 5.5 months | 12.0 lbs. | 3-4 times | 2.0 hours | 1.0 hours | Calmed |
| Jackie/Tessa | Mar. 6, 2012 | 5.5 months | 11.0 lbs | 3-4 times | 2.0 hours | 1.0 hours | Calmed |
| Jessica/Noah | Mar. 13, 2012 | 4.5 months | 14.4 lbs | 4-6 times | | 1.0 hours | Sleep |
| Charisse/Rhett | Mar. 8, 2012 | 4.0 months | 14.0 lbs | 3-4 times | 10 minutes | 2.0 hours | Sleep |
| Dolge/Ashee | Mar. 12, 2012 | 4.0 months | 14.0 lbs | 5-7 times | 3.0 hours | 1.5 hours | Sleep |
| Laura/Charlotte | Mar. 13, 2012 | 4 weeks | 10.0 lbs | 3-5 times | 1.0 hours | 10 minutes | Sleep |
| Laura/John | Mar. 15, 2012 | 6 weeks | 10.5 lbs | 1-3 times | 2.0 hours | 1.0 hours | Sleep |
| Amelia/Arthur | Mar. 15, 2012 | 6.0 months | 15.9 lbs | 3-4 times | 10 minutes | 1.0 hours | No |

-continued

| Patient/Baby Name | Test Date | Baby's Age | Baby's Weight | No. of times baby wakes during the night | Time since last nap | Time since last feeding | Calmed or put to sleep |
|---|---|---|---|---|---|---|---|
| Iris/Charlie | Apr. 23, 2012 | 4 weeks | 10.0 lbs | 4-6 times | 1.0 hours | 1.0 hours | Calmed |
| Elyse/Christian | Apr. 23, 2012 | 5 months | 13.5 lbs | 3-4 times | 1.0 hours | 1.0 hours | Sleep |
| Margaret/Halina | Apr. 28, 2012 | 4.5 months | 16.2 lbs | 3-4 times | 1.0 hours | 30 minutes | Sleep |
| Laine/Lucas | May 7, 2012 | 4 weeks | 9.5 lbs | 4-6 times | 2.0 hours | 30 minutes | Sleep |
| Rachel/Cade | May 7, 2012 | 5 months | 18.0 lbs | 3-4 times | 1.0 hours | 2.0 hours | Sleep |
| Rose/Elsie | May 8, 2012 | 4 weeks | 10.0 lbs | 4-6 times | 10 minutes | 2.0 hours | No |

CONCLUSION

It was possible to promote infant calming and sleep through the use of swaddling plus very specific sound and motion stimuli to activate the calming reflex.

EQUIVALENTS

While this invention has been particularly shown and described with references to example embodiments thereof, it will be understood by those skilled in the art that various changes in form and details may be made therein without departing from the scope of the invention encompassed by the appended claims.

The relevant teachings of all references cited herein are incorporated by reference in their entirety.

What is claimed is:

1. An infant calming/sleep-aid device, comprising:

a rigid base;

a movement linkage or bearing extending from the rigid base;

a platform mounted on the movement linkage or bearing; and an actuation assembly that controls movement of the platform about the movement linkage or bearing relative to the rigid base to rotate the platform in an reciprocating manner, the actuation assembly including a drive motor, wherein the reciprocating rotation is on an axis of rotation that intersects the platform and extends orthogonal to a major plane of the platform, and a control system operable to control operations of the actuation assembly, wherein the control system is configured to receive data signals from one or more sensors comprising at least a sound sensing device configured to detect sounds of an infant supported on the platform, wherein, if the control system determines that the infant is in a first crying state, utilizing one or more first data signals comprising at least sound data detected by the sound sensing device, the control system is configured to initiate a calming reflex operational mode in which the control system causes the actuation assembly to move the platform in a reciprocating rotation within a frequency range of between 2 and 4.5 cycles per second and an amplitude range corresponding to a circumferential distance of between 0.2 inches and 1.0 inches taken at a radial distance from the axis of rotation configured to correspond to a center of a head of the infant.

2. The infant calming/sleep-aid device of claim 1, further comprising:

a second platform comprising a moving head platform; and a second movement linkage comprising a head movement linkage or bearing mounted to the platform linking the moving platform to the second platform.

3. The infant calming/sleep-aid device of claim 1, further comprising a sound generating device that includes a speaker for generating sound directed to the infant, wherein, in the calming reflex operational mode, the control system further causes the sound generating device to direct sound to the infant.

4. The infant calming/sleep-aid device of claim 1, wherein the sound sensing device comprises at least one microphone.

5. The infant calming/sleep-aid device of claim 1, further comprising a head rest positioned above the platform, wherein the head rest includes a gel.

6. The infant calming/sleep-aid device of claim 1, further comprising a secure swaddling sack within which to swaddle an infant, and wherein the secure swaddling sack is securable to the platform to secure a position of the infant when swaddled within the secure swaddling sack with respect to the platform.

7. The infant calming/sleep-aid device of claim 1, wherein the one or more sensors further comprise a motion sensing device that detects motion of the infant when supported on the platform, and wherein the first data signals further comprise motion corresponding to perturbations of the platform detected by the motion sensing device caused by the infant during a reciprocating rotation of the platform prior to initiation of the calming reflex operational mode.

8. The infant calming/sleep aid device of claim 1, wherein the control system is configured to reduce the reciprocating rotation in a stepwise fashion if the control system determines, utilizing data signals received from the one or more sensors, that the infant is being soothed by the reciprocating rotation of the platform.

9. The infant calming/sleep-aid device of claim 1, wherein the control system is further configured to control the reciprocating rotation of the platform utilizing age of the infant as variable, and wherein at a predetermined age of the infant, the control system is configured to reduce intensity of the reciprocating rotation to wean the infant off the reciprocating rotation of the device.

10. The infant calming/sleep-aid device of claim 1, wherein the control system controls the reciprocating rotation utilizing at least one variable selected from weight of the infant, age of the infant, a duration of detected sound made by the infant, and a duration of detected motion of the infant.

11. The infant calming/sleep-aid device of claim 1, wherein the actuation assembly is configured to reciprocally rotate the platform on the axis of rotation that is configured to be positioned to intersect an infant when supported on the platform.

12. The infant calming/sleep-aid device of claim 1, wherein in a soothing operational mode, the control system controls the frequency of reciprocating rotation within a range of between 0.5 and 1.5 cycles per second with a corresponding amplitude of the reciprocating rotation at a location corresponding to the center of the head of the infant when positioned on the platform that is in a range of between 0.5 inches and 1.5 inches.

13. The infant calming/sleep-aid device of claim 12, further comprising a sound generation device comprising a speaker to generate sound directed to the infant, wherein, in the soothing mode, the control system is further configured to cause the sound generation device to output a low pitch rumbling sound directed to the infant.

14. The infant calming/sleep aid device of claim 13, wherein the control system is configured to reduce the volume of the generated sound in a stepwise fashion if the control system detects that an infant is being soothed.

15. The infant calming/sleep-aid device of claim 13, wherein the low pitched rumbling sound is output within a range between 65 dB and 75 dB.

16. The infant calming/sleep-aid device of claim 13, wherein if the control system determines, utilizing second data signals received from the one or more sensors, that the infant is not being soothed by the sound directed to the infant and reciprocating rotation of the soothing mode, the control system is configured to initiate an enhanced soothing mode comprising causing the sound generation device to direct a higher pitched sound with greater volume to the infant.

17. The infant calming/sleep-aid device of claim 16, wherein the higher pitched sound has a volume between 75 dB and 80 dB.

18. The infant calming/sleep-aid device of claim 16, wherein the second data signals comprise sound detected by the sound sensing device from which the control system determines that the infant is in a second crying state.

19. The infant calming/sleep-aid device of claim 17, wherein the one or more sensors further comprise a motion sensing device that detects motion of the infant when supported on the platform, wherein the second data signals further comprise data signals corresponding to perturbations of the platform detected by the motion sensing device caused by the infant during a reciprocating rotation of the platform in the soothing operational mode.

20. The infant calming/sleep-aid device of claim 18, wherein the control system is configured to initiate the calming reflex operational mode to transition the device from the enhanced soothing operational mode to the calming reflex operational mode if the control system receives the first data signals from which it determines that the infant is in the first crying state.

* * * * *